US010906323B2

(12) United States Patent
Nagaoka et al.

(10) Patent No.: US 10,906,323 B2
(45) Date of Patent: Feb. 2, 2021

(54) INK CARTRIDGE WITH A HOUSING SEALED BY A SEALING MEMBER THAT CHANGEABLY FORMS AN AIR COMMUNICATION PASSAGE

(71) Applicant: CANON KABUSHIKI KAISHA, Tokyo (JP)

(72) Inventors: Kyosuke Nagaoka, Kodaira (JP); Yasuo Kotaki, Yokohama (JP); Tetsuya Ohashi, Matsudo (JP); Ryoji Inoue, Kawasaki (JP); Takeho Miyashita, Yokohama (JP); Hironori Murakami, Tokyo (JP); Takayuki Tanno, Tokyo (JP); Takashi Fukushima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/573,981

(22) Filed: Sep. 17, 2019

(65) Prior Publication Data

US 2020/0101750 A1 Apr. 2, 2020

(30) Foreign Application Priority Data

Sep. 28, 2018 (JP) ..... 2018-184853

(51) Int. Cl.
*B41J 2/175* (2006.01)

(52) U.S. Cl.
CPC ..... *B41J 2/17523* (2013.01); *B41J 2/17536* (2013.01)

(58) Field of Classification Search
CPC ..... B41J 2/17523; B41J 2/17536; B41J 2/17553; B41J 2/17503; F16J 15/02
See application file for complete search history.

(56) References Cited

U.S. PATENT DOCUMENTS

| | | | | |
|---|---|---|---|---|
| 5,425,478 | A | 6/1995 | Kotaki et al. | 222/501 |
| 5,430,471 | A | 7/1995 | Nakajima et al. | 347/87 |
| 5,567,373 | A | 10/1996 | Sato et al. | 264/112 |
| 5,583,549 | A | 12/1996 | Ujita et al. | 347/86 |
| 5,589,862 | A | 12/1996 | Ujita et al. | 347/87 |
| 5,608,437 | A | 3/1997 | Iwata et al. | 347/86 |
| 5,619,237 | A | 4/1997 | Inoue et al. | 347/86 |
| 5,619,239 | A | 4/1997 | Kotaki et al. | 347/86 |
| 5,742,310 | A | 4/1998 | Kotaki | 347/86 |
| 5,781,213 | A | 7/1998 | Ujita et al. | 347/86 |
| 5,805,188 | A | 9/1998 | Nakajima et al. | 347/87 |
| 5,815,184 | A | 9/1998 | Ujita et al. | 347/87 |
| 5,852,457 | A | 12/1998 | Kotaki et al. | 347/86 |

(Continued)

FOREIGN PATENT DOCUMENTS

| | | |
|---|---|---|
| EP | 1352747 | 10/2003 |
| JP | 2013-158978 | 8/2013 |

*Primary Examiner* — Bradley W Thies
(74) *Attorney, Agent, or Firm* — Venable LLP

(57) ABSTRACT

An ink cartridge includes a housing that has an air communication port and stores a liquid inside and a sealing member attached to the housing in such a way as to cover the air communication port. The sealing member includes an adherent region attached to the housing and a non-adherent region not attached to the housing. The non-adherent region extends to an end portion of the sealing member and forms a communication passage which establishes communication between the air communication port and air.

11 Claims, 16 Drawing Sheets

(56) References Cited

U.S. PATENT DOCUMENTS 5,929,885 A 7/1999 Nakajima et al. ..... 347/87
5,988,804 A 11/1999 Kotaki et al. ..... 347/87
6,070,974 A 6/2000 Kotaki et al. ..... 347/86
6,073,812 A * 6/2000 Wade ..... A47K 5/1215 137/68.11
6,116,722 A 9/2000 Sato et al. ..... 347/85
6,145,975 A 11/2000 Kotaki et al. ..... 347/87
6,170,939 B1 1/2001 Ujita et al. ..... 347/86
6,243,116 B1 6/2001 Kotaki et al. ..... 347/86
6,336,709 B1 1/2002 Inoue et al. ..... 347/49
6,338,546 B1 1/2002 Kotaki et al. ..... 347/49
6,361,158 B1 3/2002 Inoue et al. ..... 347/86
6,390,612 B1 5/2002 Kotaki et al. ..... 347/85
6,419,350 B1 7/2002 Abe et al. ..... 347/86
6,421,623 B1 7/2002 Furukawa et al. ..... 702/100
6,623,104 B1 9/2003 Kotaki et al. ..... 347/49
6,685,296 B2 2/2004 Mochizuki et al. ..... 347/19
6,719,394 B2 4/2004 Kubota et al. ..... 347/19
6,719,416 B2 4/2004 Anma et al. ..... 347/86
6,742,881 B2 6/2004 Kotaki et al. ..... 347/86
6,773,099 B2 8/2004 Inoue et al. ..... 347/86
6,827,411 B2 12/2004 Kubota et al. ..... 347/7
6,827,431 B2 12/2004 Kitabatake et al. ..... 347/86
6,830,324 B2 12/2004 Ogura et al. ..... 347/86
6,854,836 B2 2/2005 Ishinaga et al. ..... 347/85
6,869,158 B2 3/2005 Kojima et al. ..... 347/19
6,877,847 B2 4/2005 Hayashi et al. ..... 347/86
6,916,085 B2 7/2005 Kotaki et al. ..... 347/49
6,935,739 B2 8/2005 Inoue et al. ..... 347/104
6,942,326 B2 9/2005 Hayashi et al. ..... 347/86
6,959,984 B2 11/2005 Ogura et al. ..... 347/86
6,966,631 B2 11/2005 Matsuo et al. ..... 347/49
6,969,161 B2 11/2005 Kuwabara et al. ..... 347/85
6,976,753 B2 12/2005 Kuwabara et al. ..... 347/86
6,997,535 B2 2/2006 Mochizuki et al. ..... 347/19
6,997,548 B2 2/2006 Matsuo et al. ..... 347/86
7,004,575 B2 2/2006 Inoue et al. ..... 347/86
7,014,287 B2 3/2006 Kubota et al. ..... 347/7
7,077,514 B2 7/2006 Inoue et al. ..... 347/86
7,086,725 B2 8/2006 Ogura et al. ..... 347/86
7,104,640 B2 9/2006 Ogura et al. ..... 347/86
7,111,931 B2 9/2006 Amma et al. ..... 347/86
7,118,194 B2 10/2006 Matsuo et al. ..... 347/49
7,125,109 B2 10/2006 Watanabe et al. ..... 347/86
7,128,407 B2 10/2006 Inoue et al. ..... 347/85
7,134,747 B2 11/2006 Hayashi et al. ..... 347/86
7,165,829 B2 1/2007 Hayashi et al. ..... 347/49
7,192,111 B2 3/2007 Matsumoto et al. ..... 347/7
7,210,755 B2 5/2007 Kubota et al. ..... 347/7
7,290,861 B2 11/2007 Inoue et al. ..... 347/49
7,311,388 B2 12/2007 Ogura et al. ..... 347/87
7,350,910 B2 4/2008 Amma et al. ..... 347/86
7,360,876 B2 4/2008 Inoue et al. ..... 347/85
7,384,116 B2 6/2008 Kotaki et al. ..... 347/19
7,396,118 B2 7/2008 Ogawa et al. ..... 347/87
7,401,909 B2 7/2008 Inoue et al. ..... 347/86
7,407,274 B2 8/2008 Inoue et al. ..... 347/86
7,407,275 B2 8/2008 Inoue et al. ..... 347/86
7,517,067 B2 4/2009 Inoue et al. ..... 347/85
7,607,770 B2 10/2009 Inoue et al. ..... 347/85
7,735,984 B2 6/2010 Lijima et al. ..... 347/86
7,784,927 B2 8/2010 Inoue et al. ..... 347/86
7,914,137 B2 3/2011 Inoue et al. ..... 347/86
7,922,274 B2 4/2011 Kubota et al. ..... 347/7
7,926,927 B2 4/2011 Kotaki et al. ..... 347/86
7,950,790 B2 5/2011 Kubo et al. ..... 347/86
8,020,978 B2 9/2011 Ogawa et al. ..... 347/86
8,047,641 B2 11/2011 Nanjo et al. ..... 347/86
8,109,617 B2 2/2012 Kotaki et al. ..... 347/86
8,136,930 B2 3/2012 Anma et al. ..... 347/86
8,205,974 B2 6/2012 Ogura et al. ..... 347/86
8,313,185 B2 11/2012 Hatasa et al. ..... 347/92
8,322,807 B2 12/2012 Seki et al. ..... 347/6
8,425,022 B2 4/2013 Inoue et al. ..... 347/86
8,469,498 B2 6/2013 Ohashi et al. ..... 347/86
8,529,037 B2 9/2013 Miyashita et al. ..... 347/86
8,550,607 B2 10/2013 Inoue et al. ..... 347/86
8,770,730 B2 7/2014 Nanjo et al. ..... 347/86
8,770,731 B2 7/2014 Miyashita et al. ..... 347/86
8,960,869 B2 2/2015 Takada et al. ..... 347/86
9,016,842 B2 4/2015 Miyashita et al. ..... 347/86
9,333,758 B2 5/2016 Koshikawa et al. ..... B41J 2/17523
9,375,938 B2 6/2016 Kondo et al. ..... B41J 2/1752
9,597,884 B2 3/2017 Nanjo et al. ..... B41J 2/17546
9,821,562 B2 11/2017 Nanjo et al. ..... B41J 2/17553
9,840,082 B2 12/2017 Nanjo et al. ..... B41J 2/17526
9,908,338 B2 3/2018 Koshikawa et al. ..... B41J 2/17559
9,914,305 B2 3/2018 Orihara et al. ..... B41J 2/17523
9,919,536 B2 3/2018 Miyashita et al. ... B41J 2/17553
9,962,945 B2 5/2018 Takaoka et al. ..... B41J 2/17506
9,981,477 B2 5/2018 Fukuchi et al. ..... B41J 29/02
9,981,478 B2 5/2018 Ikebe et al. ..... B41J 2/175
10,029,474 B2 7/2018 Takada et al. ..... B41J 2/17509
10,093,105 B2 10/2018 Shimamura et al. ..... B41J 2/17553
10,112,403 B2 10/2018 Ikebe et al. ..... B41J 2/17523
10,207,511 B2 2/2019 Nanjo et al. ..... B41J 2/17526
10,336,087 B2 7/2019 Miyashita et al. ... B41J 2/17553
10,399,346 B2 9/2019 Arai et al. ..... B41J 2/17553
10,399,347 B2 9/2019 Miyashita et al. ... B41J 2/17506
10,427,412 B2 10/2019 Okude et al. ..... B41J 2/17523
2001/0020971 A1* 9/2001 Usui ..... B41J 2/1752 347/86
2002/0167571 A1* 11/2002 Hayashi ..... B41J 2/17513 347/85
2004/0196340 A1* 10/2004 Inoue ..... B41J 2/17523 347/86
2004/0246304 A1 12/2004 Takahashi et al. ..... 347/49
2005/0007420 A1 1/2005 Ogawa et al. ..... 347/50
2013/0050310 A1 2/2013 Seki et al. ..... 347/6
2013/0056486 A1* 3/2013 Latta ..... B65D 75/5838 220/833
2018/0370243 A1 12/2018 Shimamura et al. ..... B41J 2/17553
2019/0023019 A1 1/2019 Ikebe et al. ..... B41J 2/17509
2019/0263132 A1 8/2019 Miyashita et al. ... B41J 2/17523
2019/0337296 A1 11/2019 Arai et al. ..... B41J 2/1752
2019/0344577 A1 11/2019 Miyashita et al. ..... B41J 2/165

* cited by examiner

| | | VALI-DATION EXAMPLE 1 | VALI-DATION EXAMPLE 2 | VALI-DATION EXAMPLE 3 | VALI-DATION EXAMPLE 4 | VALI-DATION EXAMPLE 5 | VALI-DATION EXAMPLE 6 | VALI-DATION EXAMPLE 7 | VALI-DATION EXAMPLE 8 | VALI-DATION EXAMPLE 9 | VALI-DATION EXAMPLE 10 | VALI-DATION EXAMPLE 11 | COM-PARATIVE EXAMPLE 1 | COM-PARATIVE EXAMPLE 2 |
|---|---|---|---|---|---|---|---|---|---|---|---|---|---|---|
| TYPE AND THICKNESS OF MATERIAL FOR BASE MEMBER | SGS-110 | 110 | 110 | 110 | 110 | 110 | 110 | 110 | 110 | | 110 | 110 | 110 | NO LABELS |
| | SGS-80 | | | | | | | | | 80 | | | | |
| TYPE AND COATING THICKNESS OF ADHESIVE AGENT | S-1511X | 20 | 20 | 20 | 20 | 20 | 20 | 20 | | 20 | 20 | 20 | 20 | |
| | S692N | | | | | | | | 25 | | | | | |
| NON-ADHERENT REGION | THICKNESS | 0 | 0 | 0 | 0 | 0 | 0 | 10 | 0 | 0 | 0 | 0 | NO THIN REGIONS | |
| | WIDTH | 5.0 | 0.5 | 1.0 | 8.0 | 12.0 | 15.0 | 5.0 | 5.0 | 5.0 | 5.0 | 5.0 | | |
| LAYOUT | | a | a | a | a | a | a | a | a | a | b | c | | |
| INK SUPPLY PERFORMANCE | | A | B | A | A | A | A | A | A | A | A | A | C | A |
| INK EVAPORATION RATE | | A | A | A | A | A | B | A | A | A | A | A | A | C |

FIG.11

INK CARTRIDGE WITH A HOUSING SEALED BY A SEALING MEMBER THAT CHANGEABLY FORMS AN AIR COMMUNICATION PASSAGE

BACKGROUND OF THE DISCLOSURE

Field of the Disclosure

This disclosure is related to an ink cartridge.

Description of the Related Art

An ink cartridge attachable to an inkjet printing apparatus may be provided with an air communication port in order to stabilize an internal pressure. However, evaporation of an ink is promoted in the case where the air communication port is provided, whereby a density and components of the ink may become unstable.

Japanese Patent Laid-Open No. 2013-158978 discloses an ink cartridge configured to seal an air communication port with a sealing member in the course of distribution and to allow a user to peel the sealing member off in the case of attaching the ink cartridge to an inkjet printing apparatus. The ink cartridge according to Japanese Patent Laid-Open No. 2013-158978 makes it possible to suppress evaporation of the ink in the course of distribution and to supply the ink stably while keeping an internal pressure at an atmospheric pressure after the attachment to the apparatus.

SUMMARY OF THE DISCLOSURE

In an aspect of the present invention, there is provided an ink cartridge comprising: a housing including an air communication port and configured to store a liquid inside; and a sealing member attached to the housing in such a way as to cover the air communication port, wherein the sealing member includes an adherent region attached to the housing and a non-adherent region not attached to the housing, and the non-adherent region extends to an end portion of the sealing member and forms a communication passage which establishes communication between the air communication port and air.

Further features of the present disclosure will become apparent from the following description of exemplary embodiments with reference to the attached drawings.

BRIEF DESCRIPTION OF THE DRAWINGS

FIG. 11 is a table showing results of comparison on various validation examples;

DESCRIPTION OF THE EMBODIMENTS

However, the ink cartridge disclosed in Japanese Patent Laid-Open No. 2013-158978 entrusts the user to peel the sealing member off and therefore has a risk of attachment to the apparatus without peeling the sealing member off. In this case, the internal pressure of the ink cartridge may vary with consumption of the ink and the ink may not be stably supplied to a printing head from the ink cartridge. As a consequence, there are a risk of a failure of the printing head to perform a normal ejection operation and a risk of a breakage of the printing head.

This disclosure has been made to solve the aforementioned problem and an object thereof is to provide an ink cartridge that is capable of suppressing evaporation of an ink and stabilizing supply of the ink to a printing head at the same time without placing a burden on a user such as peeling a sealing member off.

First Embodiment

Figure 1:
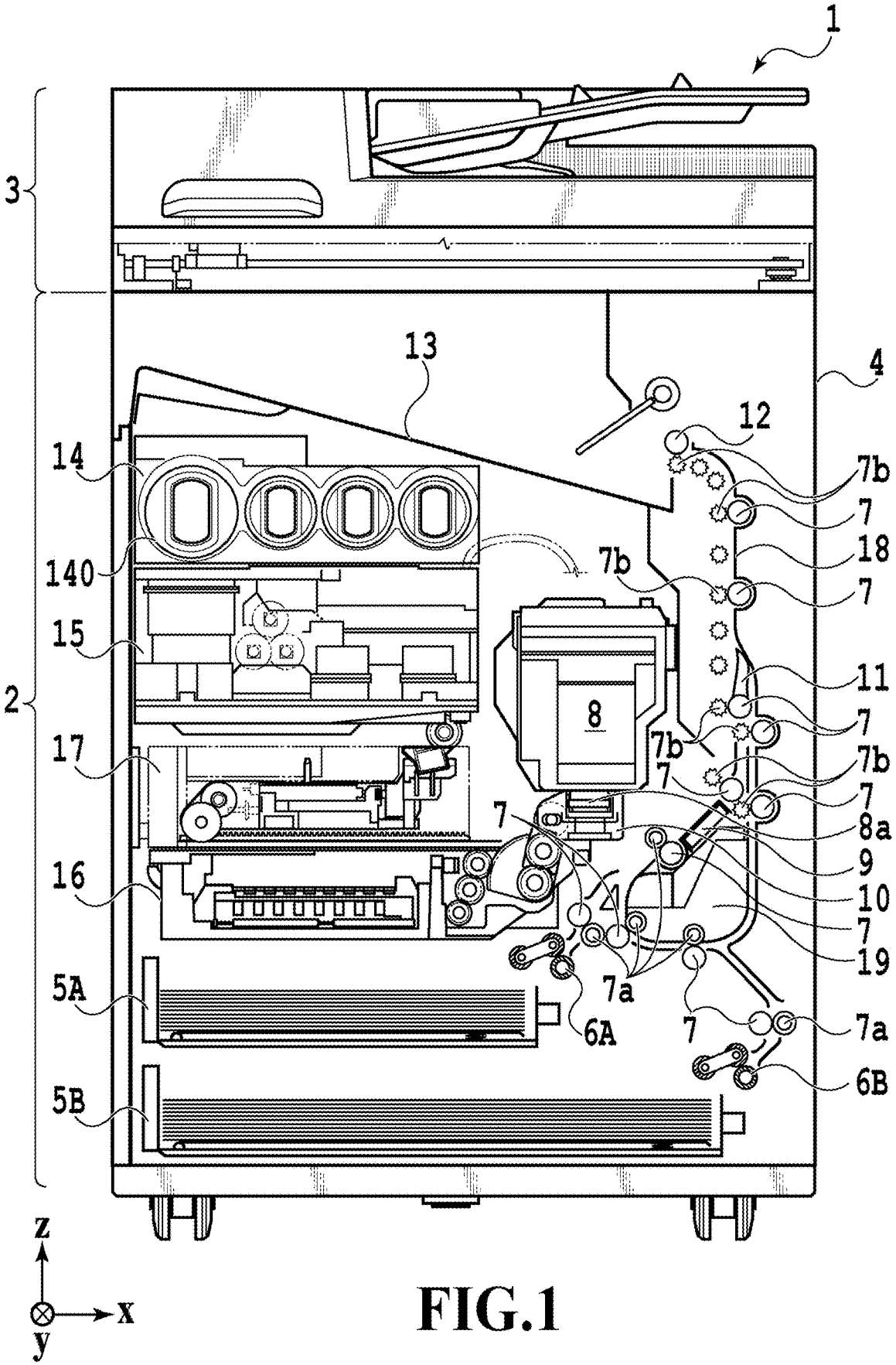
FIG. 1 is an internal configuration diagram of an inkjet printing apparatus used in a first embodiment.

FIG. 1 is an internal configuration diagram of an inkjet printing apparatus 1 (hereinafter simply referred to as a printing apparatus 1) used in a first embodiment. The printing apparatus 1 is a multifunction peripheral that includes a printing unit 2 and a scanner unit 3 located above the printing unit 2. The printing unit 2 and the scanner unit 3 can independently or jointly execute a variety of processing concerning a printing operation and a reading operation. The scanner unit 3 includes an automatic document feeder (ADF) and a flat bed scanner (FBS), and is capable of reading an original document automatically fed by the ADF and reading (scanning) an original document placed on a platen of the FBS by a user. Although FIG. 1 shows the multifunction peripheral that includes both the printing unit 2 and the scanner unit 3, the scanner unit 3 may be excluded therefrom. FIG. 1 illustrates the printing apparatus 1 in a standby state of not executing the printing operation or the reading operation.

In the printing unit 2, a first cassette 5A and a second cassette 5B for storing print media (cut sheets) S are detachably installed at a bottom portion located below an apparatus housing 4 in a direction of gravitational force. Relatively small print media up to A4 size are stored in a vertically stacked manner in the first cassette 5A while relatively large print media up to A3 size are stored in a vertically stacked manner in the second cassette 5B. In the vicinity of the first cassette 5A, there is provided a first feed unit 6A for feeding the stored print media one by one separately. Likewise, a second feed unit 6B is provided in the vicinity of the second cassette 5B. In the case where a printing operation takes place, the print medium S is fed selectively from one of the cassettes.

Conveyance rollers 7, a discharge roller 12, pinch rollers 7*a*, pinions 7*b*, a guide 18, an inner guide 19, and a flapper 11 constitute a conveyance mechanism for guiding the print media S in a predetermined direction. The conveyance rollers 7 are driving rollers which are arranged on an upstream side and a downstream side of a printing head 8 and are driven by a not-illustrated conveyance motor. The pinch rollers 7*a* are driven rollers to be rotated while nipping the print media S in cooperation with the conveyance rollers 7. The discharge roller 12 is a driving roller arranged on a downstream side of the conveyance rollers 7 and is driven by the not-illustrated conveyance motor. The pinions 7*b* sandwich and convey the print media S in cooperation with the conveyance rollers 7 and the discharge roller 12 arranged on the downstream side of the printing head 8.

The guide 18 is provided on a conveyance path for the print media S and guides the print media S in a predetermined direction. The inner guide 19 has a curved side surface that extends in a y direction and guides the print media S along the side surface. The flapper 11 is configured to switch the direction of conveyance of each print medium S at the time of a duplex printing operation. A discharge tray 13 is a tray for stacking and holding the print media S discharged by the discharge roller 12 after completion of the printing operation.

The printing head 8 shown in FIG. 1 is a full line-type inkjet printing head in which multiple ejection ports that eject inks in accordance with printing data are arranged in the y direction as long as the width of the print media S. In addition, the above-mentioned ejection port arrays extending in the y direction are arranged so as to correspond to yellow, cyan, magenta, and black inks, respectively, in the printing head 8.

In the case where the printing head 8 is located at a standby position, an ejection port surface 8*a* of the printing head 8 is capped with a cap unit 10 as shown in FIG. 1. In the case where the printing operation takes place, an orientation of the printing head 8 is changed such that the ejection port surface 8*a* is opposed to a platen 9. The platen 9 is formed from a flat plate that extends in the y direction and supports the print media S subjected to the printing operation with the printing head 8 from back surfaces of the print media S.

An ink tank unit 14 includes an attachment unit 140 for attaching ink cartridges 20. Each ink cartridge 20 attached to the attachment unit 140 can supply the ink stored inside to an ink supply unit 15. Although the attachment unit 140 may be fixed to the printing apparatus 1, the attachment unit 140 may be made detachable from the printing apparatus 1 instead. In this embodiment, the attachment unit 140 is capable of detachably attaching the ink cartridges 20 that store the cyan, yellow, magenta, and black inks, respectively.

The ink supply unit 15 is provided in the middle of a flow passage that connects the ink tank unit 14 to the printing head 8, and adjusts pressures and flow rates of the inks in the printing head 8 to appropriate ranges. This embodiment adopts a circulating type ink supply system and the ink supply unit 15 adjusts the pressures of the inks supplied to the printing head 8 and the flow rates of the inks collected from the printing head 8 to appropriate ranges.

A maintenance unit 16 includes the cap unit 10 and a wiping unit 17. The maintenance unit 16 operates these units at predetermined timings to perform a maintenance operation on the printing head 8.

Figure 2A:
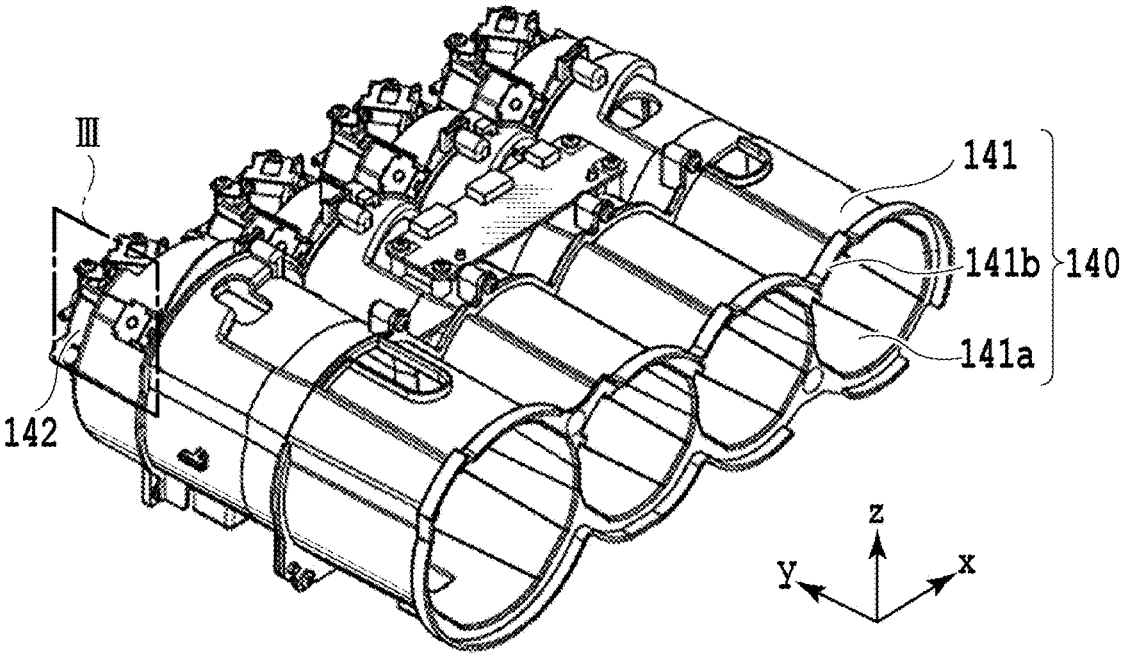
FIGS. 2A and 2B are external perspective views of an attachment unit.
Figure 2B:
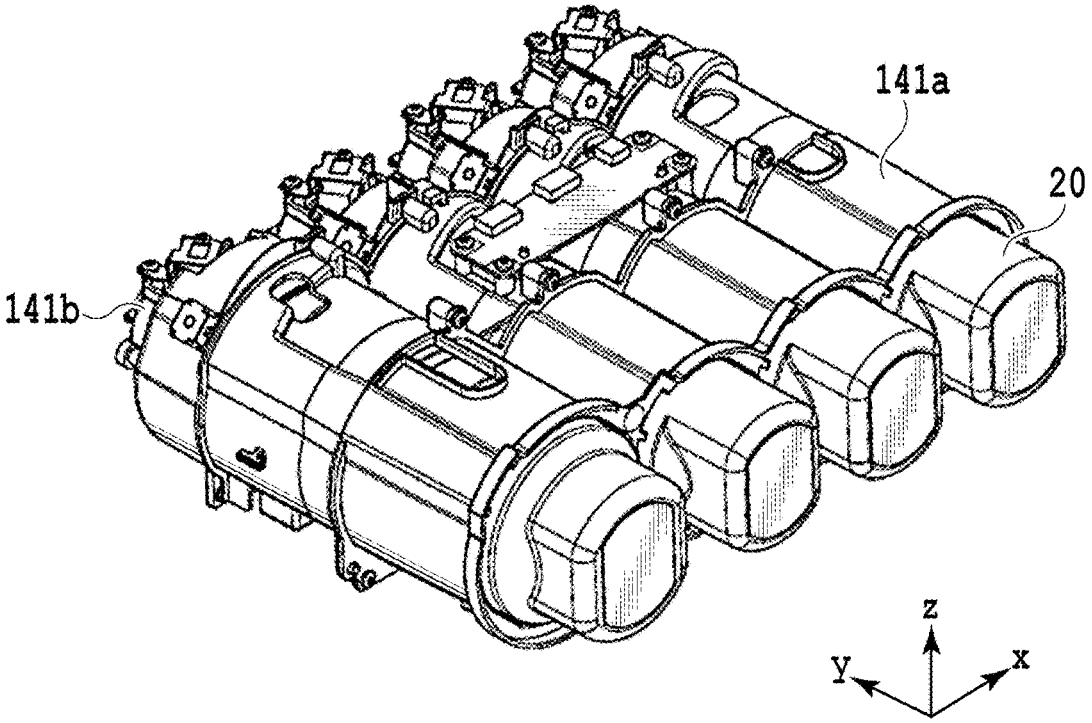
Figure 3A:
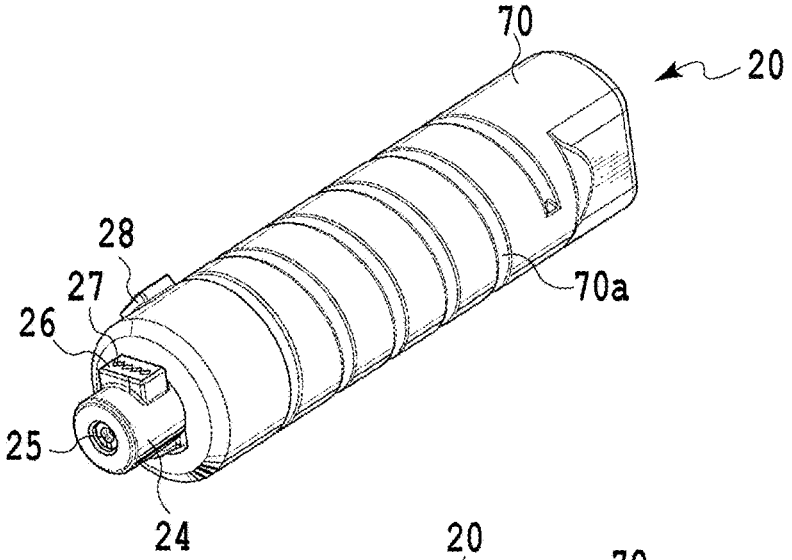
FIGS. 3A to 3D are diagrams of an ink cartridge viewed from various angles.
Figure 3B:
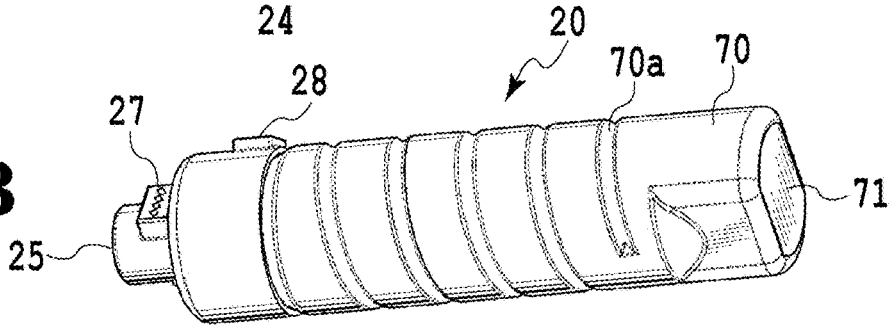
Figure 3C:
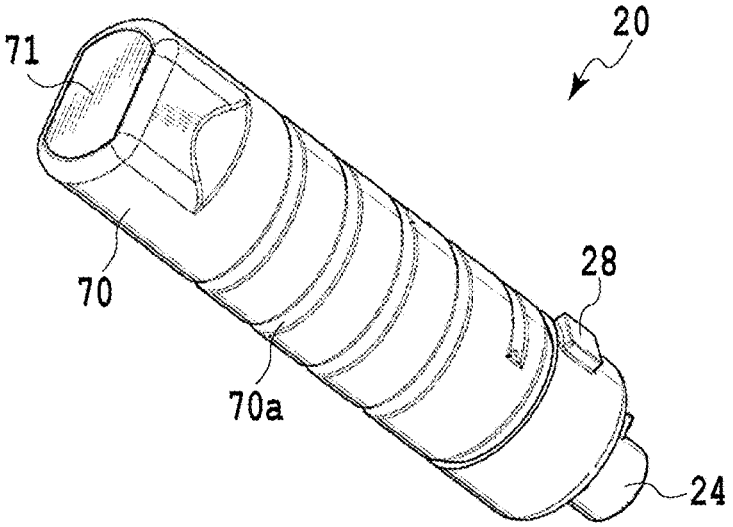
Figure 3D:
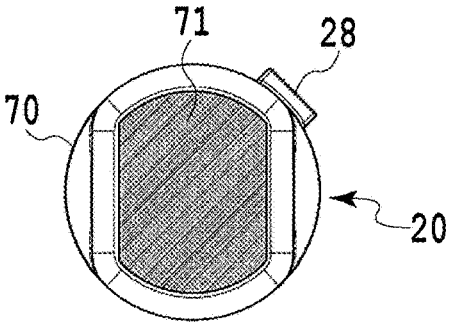

FIGS. 2A and 2B are external perspective views of the attachment unit 140. FIG. 2A shows a state where the ink cartridges 20 are not attached and FIG. 2B shows a state where the ink cartridges 20 are attached.

The attachment unit 140 includes first cases 141 each being formed of a substantially cylindrical shape and capable of inserting the ink cartridge 20, and second cases 142 each having a smaller diameter than that of the corresponding first case 141. The first cases 141 and the second cases 142 have spaces both taking on cylindrical shapes and being continuous inside. An ID recess 141*b* for loosely positioning each ink cartridge in the case is formed around an opening (a first opening) 141*a* of each first case 141. Meanwhile, although not illustrated in FIGS. 2A and 2B, each second case 142 is provided with connecting pins 23*b* that are connectable to pad electrodes 27 provided to the ink cartridge 20 (see FIG. 4). In the case where the ink cartridge 20 is attached to the attachment unit 140, a user inserts the ink cartridge 20 in the y direction from the first opening 141*a* of the first case 141 such that a tip end of the ink cartridge 20 reaches a top end of the second case 142 or the neighborhood thereof.

The first opening 141*a* of the first case 141 does not have to be of an exact circle. Nonetheless, the diameter (a length corresponding to the diameter of a circle) of the first opening 141*a* is preferably in a range from 50 mm to 90 mm inclusive. Examples of a material forming the first case 141 include acrylonitrile butadiene styrene (ABS) copolymer resin, modified polyphenylene oxide (PPO), high impact polystyrene (HIPS) resin, and the like. Examples of a material forming the second case 142 include polypropylene (PP), modified polyphenylene oxide (PPO), and the like. Although this embodiment describes the first case 141 and the second case 142 as separate components, these components may be integrally formed instead.

FIGS. 3A to 3D are diagrams of the ink cartridge 20 viewed from various angles. The ink cartridge 20 includes a housing 70 formed substantially into a cylindrical shape and a joint unit 24 having a cylindrical shape smaller than the housing 70. In the state where the ink cartridge 20 is attached to the attachment unit 140, the housing 70 is mainly supported by the first case 141 while the joint unit 24 is mainly supported by the second case 142.

A groove 70*a* such as one in a screw is formed in an outer periphery of a side surface of the housing 70 in order to increase strength of the housing 70. The groove 70*a* may be formed from one continuous part or from two or more discontinuous parts. Meanwhile, an ID projection 28 that establishes a relation of engagement with the ID recess 141*b* on the first case 141 is provided on the outer periphery of the side surface of the housing 70. Moreover, a sealing member 71 is attached to a bottom portion of the housing 70. The sealing member 71 will be described in detail later.

In the meantime, a coupling unit 25 being an opening is provided at a tip end of the joint unit 24 and an electrode unit 26 in a convex shape is provided on a side surface of the joint unit 24. The pad electrodes 27 are arranged on a top surface of the convex portion of the electrode unit 26.

In this embodiment, the length of the housing 70 is preferably in a range from 190 mm to 220 mm inclusive. Meanwhile, the diameter of the housing 70 is preferably in a range from 50 mm to 80 mm inclusive. In this case, the diameter of the housing 70 may be changed depending on the color of the ink so as to change the amount of the ink storable in the ink cartridge 20 depending on the type of the ink. For example, if the diameter of the housing of the ink cartridge 20 for a black ink is set to 75 mm and the diameter of the housing of a color ink is set to 55 mm, it is possible to store a larger amount of the ink in the ink cartridge 20 for the black ink than the one for the color ink.

In the meantime, the length of the joint unit 24 is preferably in a range from 20 mm to 30 mm inclusive. The diameter of the joint unit 24 is preferably in a range from 20 mm to 30 mm inclusive. The diameter of the coupling unit 25 is preferably in a range from 2 mm to 5 mm inclusive. The dimensions of the joint unit 24 and the coupling unit 25 are preferably the same among the ink cartridges 20 for all the colors irrespective of the volumes thereof.

In this embodiment, examples of a material forming the electrode unit 26 include polyethylene (PE), polypropylene (PP), and the like. Examples of a material forming the pad electrodes 27 include Ni, Au, and the like. Examples of a material forming the ID projection 28 include polyethylene (PE), polypropylene (PP), and the like.

Figure 4:
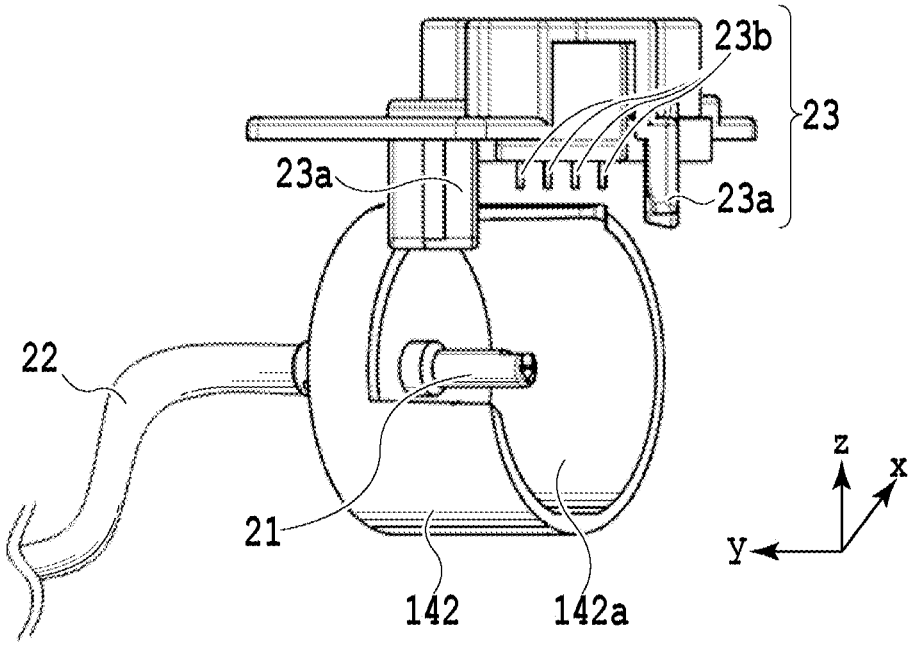
FIG. 4 is an enlarged cross-sectional view of a second case.

FIG. 4 is an enlarged cross-sectional view of the second case 142. An ink receiving pipe 21 projects from a bottom surface of the second case 142. In the case where the ink cartridge 20 is inserted in the y direction, the ink receiving pipe 21 is coupled with the coupling unit 25 of the ink cartridge 20. The ink receiving pipe 21 is linked with a tube 22 connected to the ink supply unit 15. As a consequence of coupling the ink receiving pipe 21 with the coupling unit 25, the ink stored in the ink cartridge 20 can be supplied to the ink supply unit 15.

In this embodiment, the diameter of the second case 142 is preferably in a range from 20 mm to 30 mm inclusive and smaller than that of the first opening 141*a*. An inner diameter of the ink receiving pipe 21 is preferably in a range from 2 mm to 5 mm inclusive or more preferably in a range from 3 mm to 4 mm inclusive. Examples of a material forming the ink receiving pipe 21 include stainless steel (SUS), modified polyphenylene oxide (PPO), and the like.

An electrical connection unit 23 is provided on a side surface of the second case 142. The electrical connection unit 23 includes two positioning units 23*a*, and the connecting pins 23*b* are arranged between these two positioning units 23*a*. In the case where the ink cartridge 20 is inserted in the y direction, the positioning units 23*a* come into contact with side surfaces of the electrode unit 26 of the ink cartridge 20 so as to position the ink cartridge 20. Due to this positioning, each connecting pin 23*b* and the corresponding pad electrode 27 of the ink cartridge 20 are electrically connected to each other. Note that the electrical connection unit 23 does not always have to be provided on the side surface of the second case 142. The electrical connection unit 23 may be detachable from the attachment unit 140.

In this embodiment, examples of a material forming the positioning units 23*a* include PPO, ABS, SUS, and the like. Examples of a material forming the connecting pins 23*b* include a copper alloy (plated with gold) and the like. In the electrical connection unit 23, a material forming portions other than the positioning units 23*a* and the connecting pins 23*b* include ABS, polycarbonate (PC), and the like.

Figure 5A:
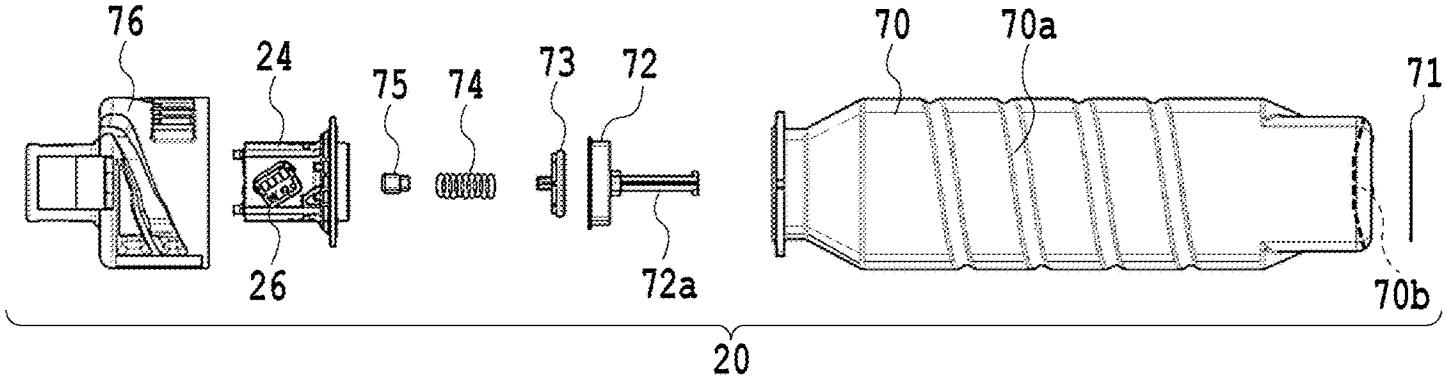
FIGS. 5A and 5B are diagrams for explaining a structure of the ink cartridge.
Figure 5B:
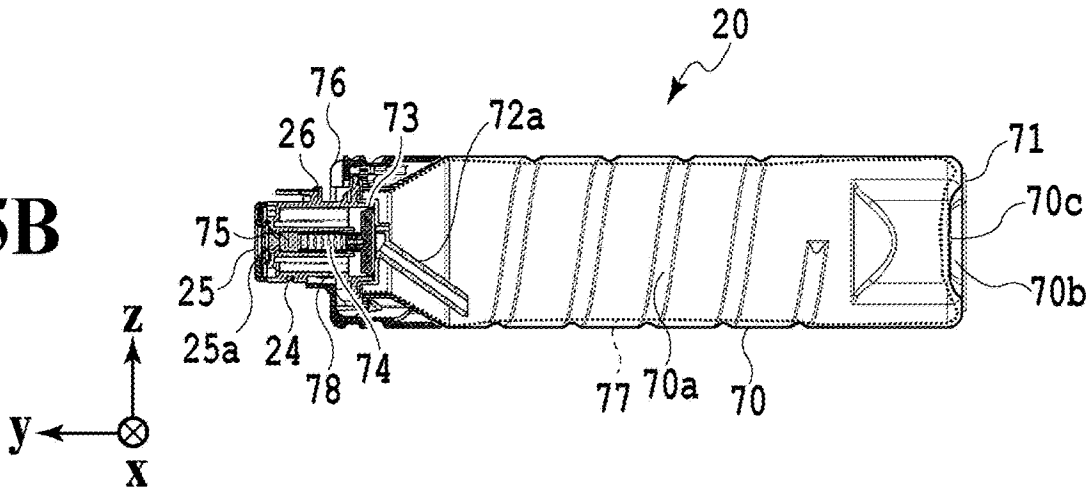

FIGS. 5A and 5B are diagrams for explaining a structure of the ink cartridge 20. FIG. 5A is an exploded diagram of the ink cartridge 20 and FIG. 5B is a cross-sectional view of the ink cartridge 20 before being attached to a printing apparatus.

As shown in FIG. 5A, the ink cartridge 20 is formed by attaching a flow passage member 72, an air check valve 73, a spring 74, a supply port valve 75, the joint unit 24, and a cover member 76 in this order to an opening (the left side) of the housing 70. Meanwhile, the bottom portion (the right side) of the housing 70 is formed into a concave shape (hereinafter referred to as a bottom concave portion 70*b*) and the sealing member 71 is attached so as to cover this bottom concave portion 70*b*.

As shown in FIG. 5B, an inner bag 77 having an opening in common with the housing 70 is provided inside the housing 70 and the ink is stored in the inner bag 77. Here, the inner bag 77 is part of the housing 70. Accordingly, the housing 70 can also be regarded as a two-layered structure that includes an inner layer (the inner bag 77) and an outer layer. An air communication port 70*c* is formed in the bottom concave portion 70*b* and a space between the housing 70 and the inner bag 77 is kept at an atmospheric pressure in the case where the air communication port 70*c* is open. In light of introduction of the air and suppression of evaporation, the diameter of the air communication port 70*c* is preferably in a range from 0.1 mm to 10.0 mm inclusive or more preferably in a range from 0.5 mm to 5.0 mm inclusive. The inner bag 77 is low in rigidity and has flexibility. Accordingly, the inner bag 77 shrinks gradually along with consumption of the ink. On the other hand, the housing 70 (the outer layer) having relatively high rigidity retains the original shape irrespective of an amount of consumption of the ink.

The housing 70 and the inner bag 77 are preferably formed by injection blowing. Examples of a material forming the housing 70 include polyethylene terephthalate (PET), polybutylene terephthalate (PBT), and the like. Examples of a material forming the inner bag 77 include polyethylene (PE), polypropylene (PP), and the like.

The flexural modulus of the housing 70 is preferably equal to or above 300 MPa, more preferably equal to or above 800 MPa, or even more preferably equal to or above 1500 MPa. The flexural modulus of the inner bag 77 is preferably equal to or below 1000 MPa, more preferably equal to or below 500 MPa, or even more preferably equal to or below 300 MPa.

The flow passage member 72 includes a nozzle 72*a* for guiding the ink stored in the inner bag 77. The nozzle 72*a* is inclined in accordance with the gravitational force as shown in FIG. 5B so that a tip end of the nozzle 72*a* can reach the ink stored in the inner bag 77 easily even if the amount of the remaining ink is decreased.

In the case where the ink cartridge 20 is not attached to the attachment unit 140, the spring 74 biases the supply port valve 75 leftward and the air check valve 73 rightward as shown in FIG. 5B. The supply port valve 75 biased leftward by the spring 74 comes into contact with a seal 25*a* and blocks the coupling unit 25 (see FIG. 3A) of the joint unit 24 from inside. The air check valve 73 biased rightward in FIG. 5B blocks the opening of the housing 70 with the flow passage member 72, thus keeping the air from being mixed into the inner bag 77.

In a manufacturing process of the ink cartridge 20, the ink is injected into the inner bag 77, then the joint unit 24 is joined to the housing 70, and then the air is discharged from an air discharge hole 78 in the joint unit 24. Thereafter, the air discharge hole 78 is sealed with a film. Here, the air check valve 73 is installed so as not to cause the air to flow back into the inner bag 77 in a period between an air discharge process and a film welding process.

The joint unit 24 to which the flow passage member 72 is attached is joined to the inner bag 77 of the housing 70 in the state of housing the supply port valve 75, the spring 74, and the air check valve 73 inside the joint unit 24. The cover member 76 is a member for protecting the joint unit 24, and is attached in such a way as to cover the entire joint unit 24 and part of the housing 70. The cover member 76 is provided with a not-illustrated opening for exposing the coupling unit 25 of the joint unit 24. In the case where the ink cartridge 20 is attached to the attachment unit 140, the ink receiving pipe 21 (see FIG. 4) is inserted into the coupling unit 25 through this opening.

In the case where the ink receiving pipe 21 is inserted from the left side in FIG. 5B into the coupling unit 25, the supply port valve 75 moves in the right direction of FIG. 5B against the spring 74, whereby the seal 25*a* is detached from the coupling unit 25 and the coupling unit 25 is thus opened. In the case where the inside of the joint unit 24 is decompressed in this state, the air check valve 73 moves in the right direction against the bias of the spring 74, whereby the inside of the inner bag 77 is fluidically connected to the ink receiving pipe 21.

In this embodiment, examples of a material forming the flow passage member 72 include polyethylene (PE), polypropylene (PP), and the like. Examples of a material forming the air check valve 73 include polyethylene (PE), polypropylene (PP), and the like. Examples of a material forming the spring 74 include stainless steel (SUS) and the like. Examples of a material forming the seal 25*a* include rubbers, elastomers, and the like. Examples of a material forming the cover member 76 include PE, PP, acrylonitrile butadiene styrene (ABS) copolymer resin, and the like. The length of the cover member 76 is preferably in a range from 60 mm to 80 mm inclusive or more preferably in a range from 10 mm to 70 mm inclusive.

Figure 6:
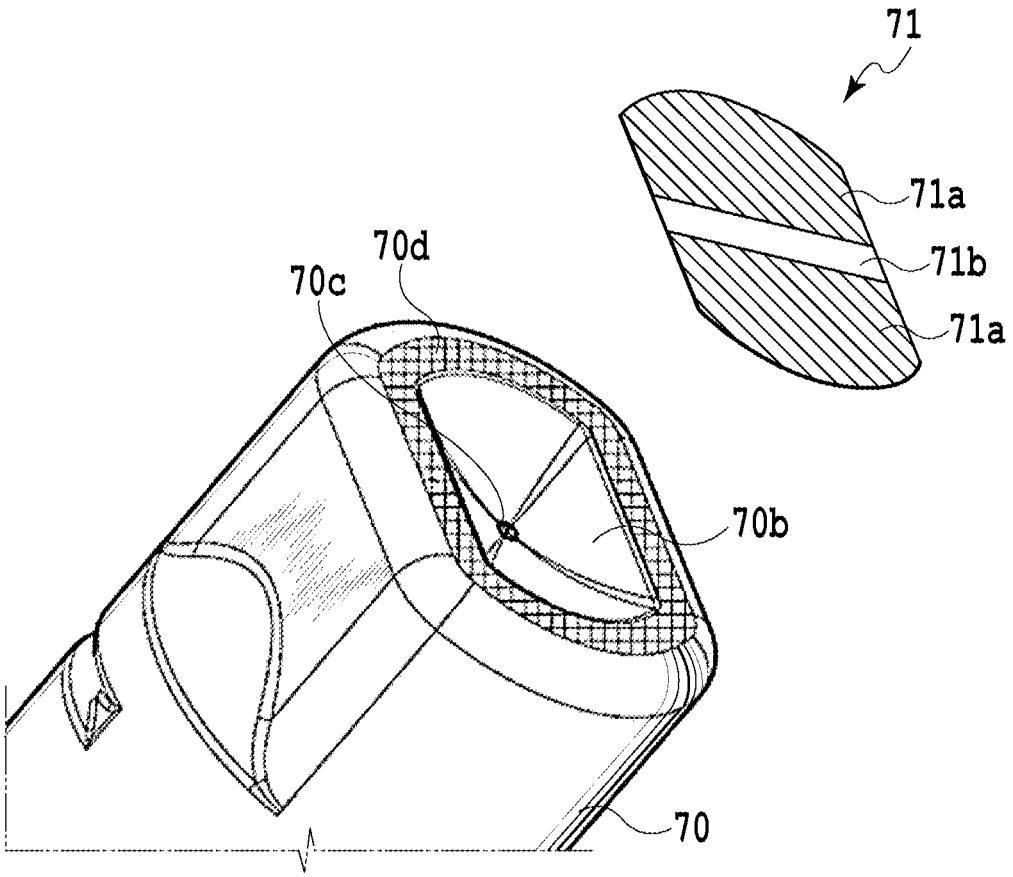
FIG. 6 is a perspective view showing a portion in the vicinity of a bottom surface of the ink cartridge.

FIG. 6 is a perspective view showing a portion in the vicinity of a bottom surface of the ink cartridge 20. As described earlier, the housing 70 of the ink cartridge 20 includes the bottom concave portion 70*b* at the bottom portion. In this embodiment, the air communication port 70*c* is provided at the center of the bottom concave portion 70*b*. The sealing member 71 includes an adherent region 71*a* where an adhesive agent is applied and a non-adherent region 71*b* where the adhesive agent is not applied. The sealing member 71 is attached to a sealing member attachment region 70*d* located around the bottom concave portion 70*b* whereby the space in the bottom concave portion 70*b* is covered with the sealing member 71 serving as a lid. In this case, the non-adherent region 71*b* of the sealing member 71 is located immediately above the air communication port 70*c*.

The ink cartridge 20 manufactured as described above is put into distribution in the state where the sealing member 71 is attached thereto. Then, a user attaches the ink cartridge 20 to the attachment unit 140 (see FIGS. 2A and 2B) of the printing apparatus 1 without peeling the sealing member 71 off the ink cartridge 20.

Figure 7A:
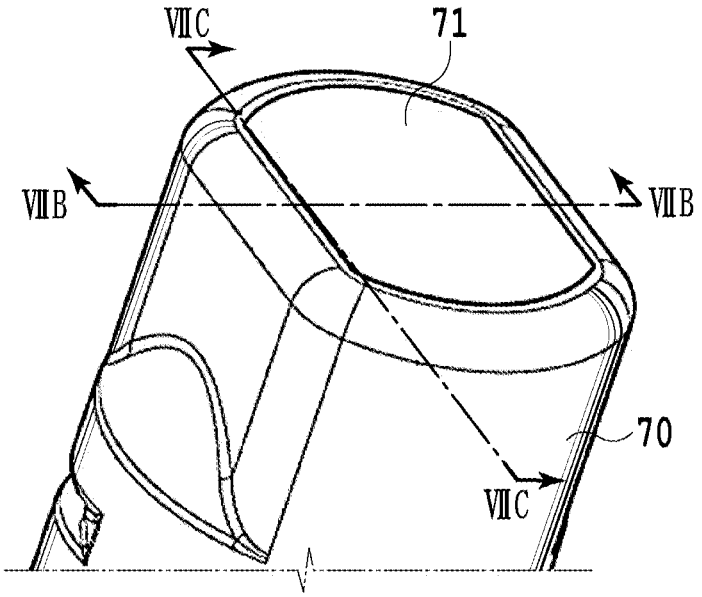
FIGS. 7A to 7C are diagrams showing a bottom portion of a housing in a case where an ink is not supplied.
Figure 7B:
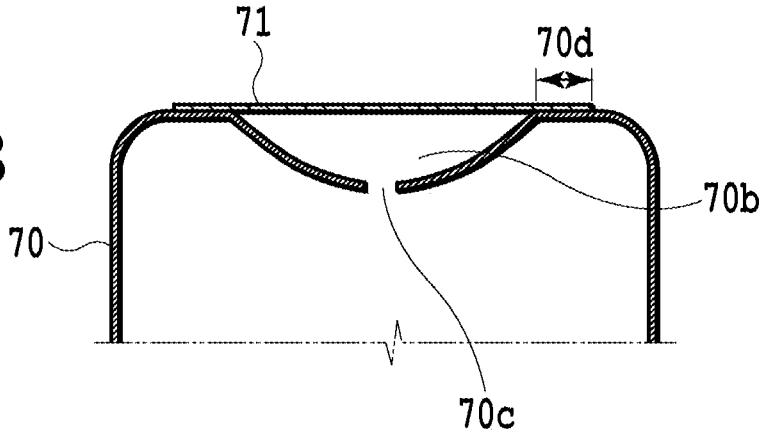
Figure 7C:
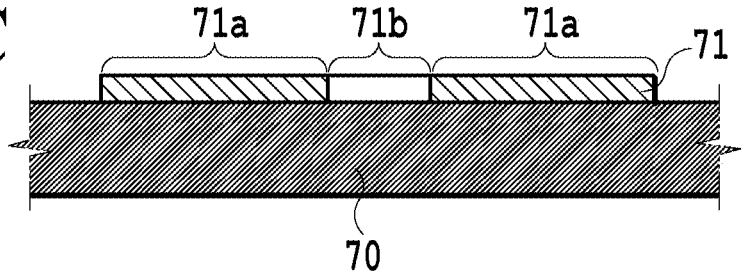

FIGS. 7A to 7C are diagrams showing the bottom portion of housing 70 in the case where the ink is not supplied from the ink cartridge 20. FIG. 7A is an external perspective view. FIG. 7B is a cross-sectional view taken along the non-adherent region 71*b* of the sealing member 71 so as to pass through the air communication port 70*c*. FIG. 7C is a cross-sectional view in the sealing member attachment region 70*d*.

In the case where the ink is not supplied, the space in the bottom concave portion 70*b* is kept at the atmospheric pressure and the sealing member 71 is kept flat and smooth as shown in FIGS. 7B and 7C. For this reason, the space defined by the sealing member 71 and the bottom concave portion 70*b* is blocked whereby evaporation of the ink through the air communication port 70*c* is suppressed.

Figure 8A:
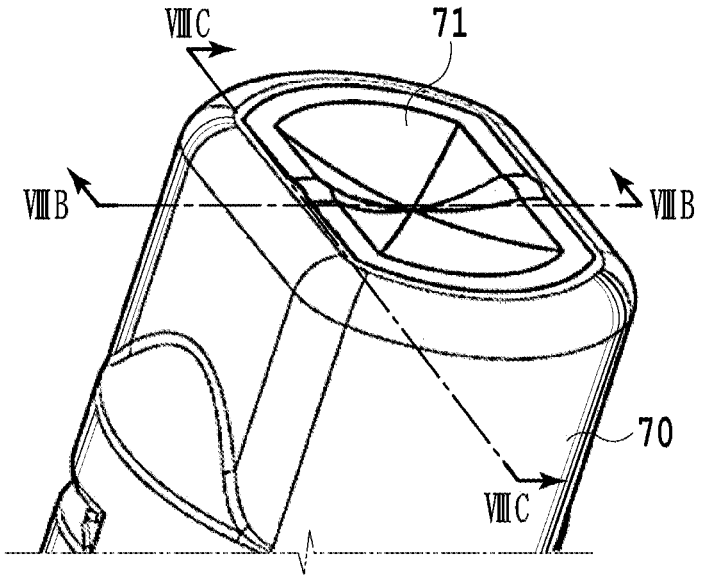
FIGS. 8A to 8C are diagrams showing the bottom portion of the housing in a case where the ink is supplied.
Figure 8B:
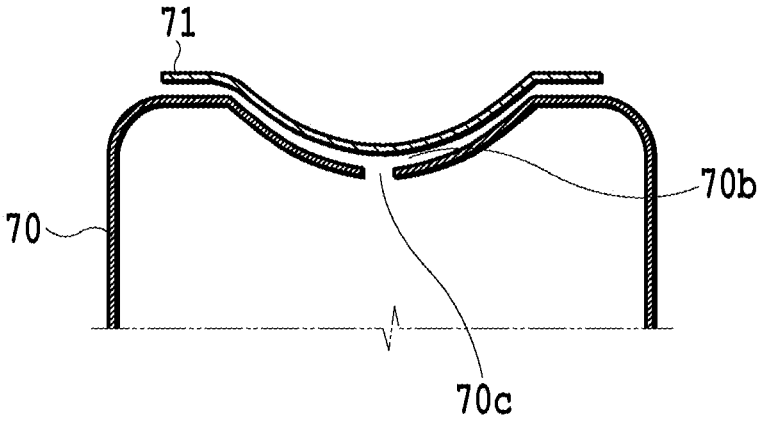
Figure 8C:
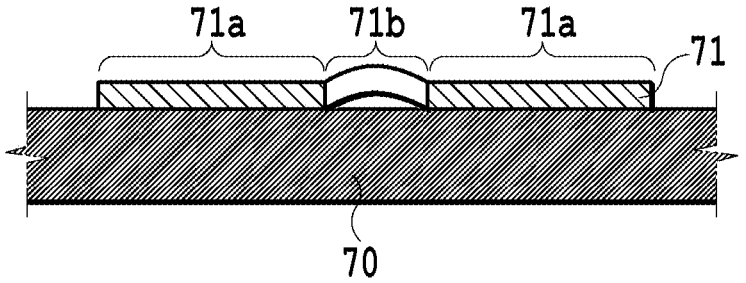

FIGS. 8A to 8C are diagrams showing the bottom portion of the housing 70 in a case where the ink is supplied from the ink cartridge 20 to the ink supply unit 15 (see FIG. 1). FIGS. 8A to 8C illustrate the bottom portion as with FIGS. 7A to 7C. In the case where the ink is supplied, the inside of the housing 70 is decompressed due to the shrinkage of the inner bag 77. Accordingly, the space in the bottom concave portion 70*b* has a negative pressure through the air communication port 70*c* whereby the sealing member 71 located above the bottom concave portion 70*b* is recessed toward the air communication port 70*c* as shown in FIG. 8B. On the other hand, in the sealing member attachment region 70*d*, the non-adherent region 71*b* not attached to the housing 70 is embossed due to a reactive force as shown in FIG. 7C. As a consequence, a communication passage for establishing communication of the air with the air communication port 70*c* is defined between the non-adherent region 71*b* and the housing 70 and the air is guided to the bottom concave portion 70*b* which is in the decompressed state. Then, in the case where the supply of the ink is completed and the space in the bottom concave portion 70*b* reaches the atmospheric pressure, the sealing member 71 goes back to the flat and smooth state again as shown in FIGS. 7A to 7C.

The above-mentioned guide of the air into the housing 70 is effectively achieved by the presence of the bottom concave portion 70*b*, because the presence of the bottom concave portion 70*b* increases an amount of displacement of the sealing member 71 and the reactive force of the sealing member 71 in the non-adherent region 71*b* is increased as well. As described above, this embodiment can achieve both an effect of suppressing evaporation of the ink and an effect of stably supplying the ink at the same time by covering the entire bottom concave portion 70*b* inclusive of the air communication port 70*c* with the sealing member 71 provided with the non-adherent region 71*b*.

In the above description, the region in the sealing member 71 provided with the adhesive agent is defined as the adherent region 71*a* while the region therein not provided with the adhesive agent is defined as the non-adherent region 71*b*. However, the adherent region 71*a* and the non-adherent region 71*b* are not necessarily defined by the presence of the adhesive agent or adhesiveness. For example, even if the adhesive agent is applied to the entire surface of the sealing member 71, there may still be a portion which does not adhere to the housing due to the thickness of the adhesive agent (an adhesive layer). For instance, a portion having a relatively small thickness of the adhesive agent has the adhesive agent and adhesiveness but does not adhere to the housing. On the other hand, there may also be a case in which a portion has an adhesive agent but does not possess adhesiveness due to hardening of the adhesive agent caused by light irradiation or the like. Such a portion does not adhere to the housing either. In other words, of the entire region of the sealing member 71, the adherent region 71*a* is the region that adheres to the housing while the non-adherent region 71*b* is the region that does not adhere to the housing.

Figure 9A:
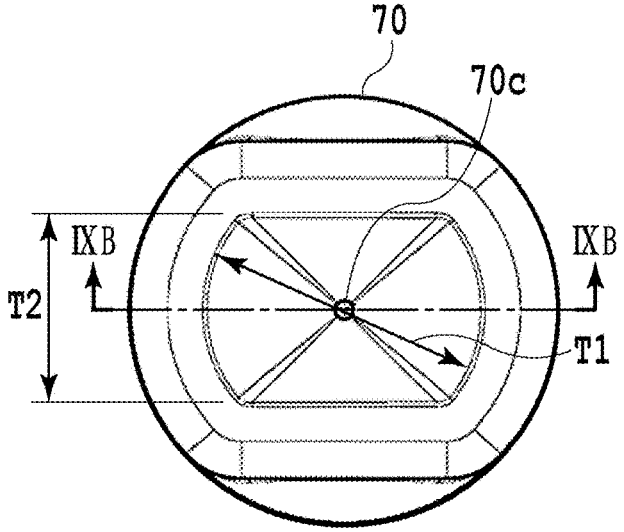
FIGS. 9A to 9D are diagrams for explaining a preferred example of dimensions of a bottom concave portion.
Figure 9B:
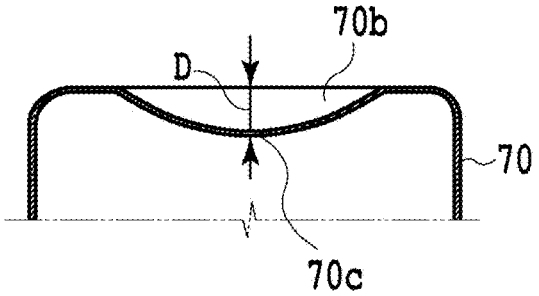
Figure 9C:
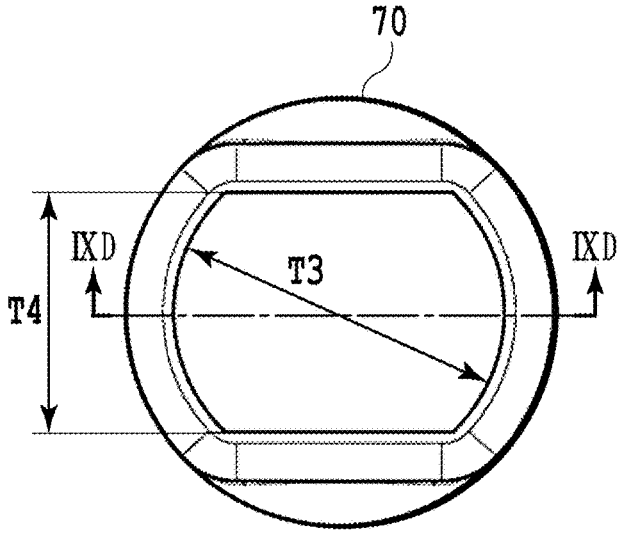
Figure 9D:
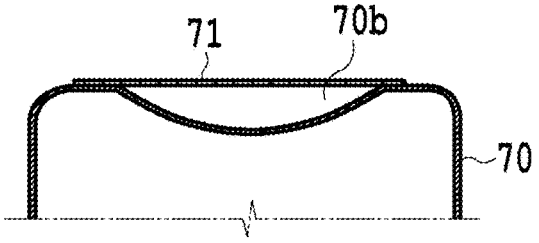

FIGS. 9A to 9D are diagrams for explaining a preferred example of dimensions of bottom concave portion 70*b*. FIG. 9A is a plan view and FIG. 9B is a cross-sectional view of the bottom portion of the housing 70 before the sealing member 71 is attached thereto. On the other hand, FIG. 9C is a plan view and FIG. 9D is a cross-sectional view of the bottom portion of the housing 70 after the sealing member 71 is attached thereto.

The shape of the bottom concave portion 70*b* may be a curved shape or a shape that includes a flat surface. A depth D of the bottom concave portion 70*b* is preferably equal to or above 0.5 mm or more preferably equal to or above 2.0 mm from the viewpoint of an ink supply performance.

The bottom concave portion 70*b* of this embodiment has a shape of a part of a circle having a diameter T1=ϕ 35 mm. Here, a dimension in a short side direction of the bottom concave portion 70*b* is set to T3=25 mm and the depth thereof is set to D=6 mm. The air communication port 70*c* has a diameter of ϕ 2.5 mm and is located at the center and the deepest position of the bottom concave portion 70*b*. The sealing member 71 is in an almost scaling relationship with the bottom concave portion 70*b*, and the diameter of the sealing member 71 is set to T3=ϕ 45 mm and a dimension in a short side direction thereof is set to T4=35 mm.

In order to increase the ink supply performance, the sealing member 71 needs to be flexibly deformable along with the decompression inside the housing 70. In this regard, a width of the sealing member attachment region 70*d* (a width T2 in the vicinity of the non-adherent region 71*b* in particular) is preferably equal to or below 20 mm or more preferably equal to or below 10 mm.

Figure 10C:
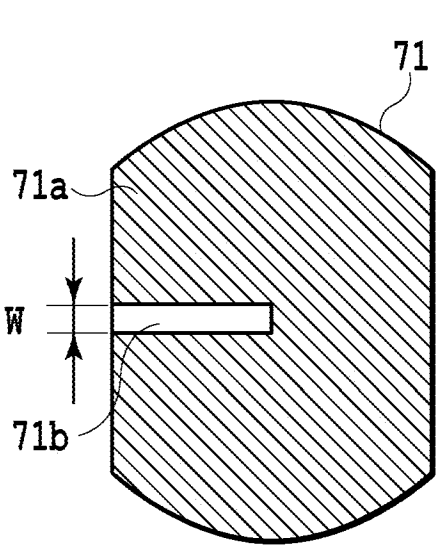
FIGS. 10A to 10C are diagrams showing layout examples of an adherent region and a non-adherent region.
Figure 10B:
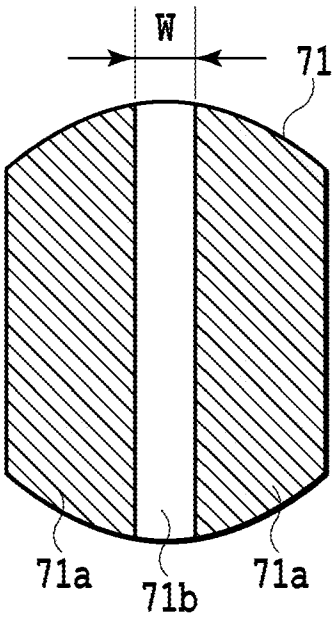
Figure 10A:
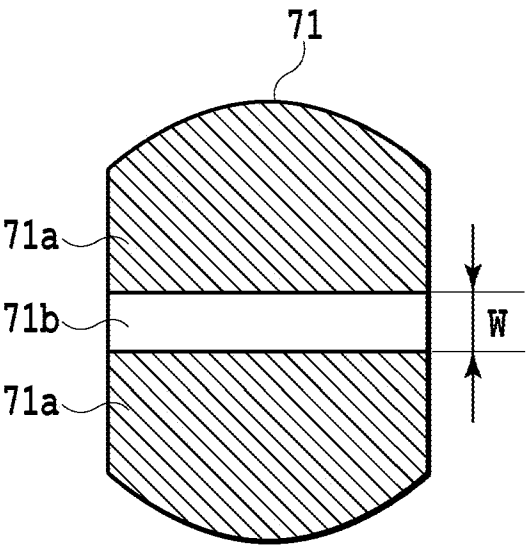

FIGS. 10A to 10C are diagrams showing layout examples of the adherent region 71*a* and the non-adherent region 71*b* in the sealing member 71 applicable to this embodiment. FIG. 10A shows an example in which the non-adherent region 71*b* extends in the short side direction of the sealing member 71. This example corresponds to the layout shown in FIG. 6.

FIG. 10B shows an example in which the non-adherent region 71*b* extends in a long side direction of the sealing member 71. FIG. 10C shows an example in which the non-adherent region 71*b* extends in the short side direction from the center to one side of the sealing member 71. In any of these cases, the non-adherent region 71*b* is provided at the center position where the air communication port 70*c* is located.

In the following, specific examples of the sealing member suitably applicable to this embodiment will be described. In general, the sealing member 71 is formed at least from the adhesive layer and a base member and is used in such a way to attach the portion of the adhesive layer to the ink cartridge 20. A base member portion may be subjected to a printing process or a surface treatment such as lamination as needed.

The base member of the sealing member can be selected from various materials while taking into account its printing properties and the like. Any of paper, synthetic paper, a plastic film, a metal foil, and a laminated body thereof can be used as the base member, for example. Examples of the paper include water-resistant paper such as art paper and coated paper, Japanese traditional paper, and the like. Examples of the synthetic paper include void-containing synthetic paper, synthetic paper according to an internal paper manufacturing method, synthetic paper according to a surface coating method, synthetic paper according to a spun-bonding method, and the like.

Examples of the plastic film include polyolefin films such as a polypropylene film and a polyethylene film, and polyester films such as a polyethylene terephthalate film. Alternatively, the plastic film may be a foamed plastic film such as a foamed polystyrene film, a foamed polyester film, and a foamed polyolefin film. The plastic film may be any one of a stretched film (a uniaxial stretched film or a biaxial stretched film) and a non-stretched film. Meanwhile, the plastic film may be any one of transparent, translucent, and opaque films. Examples of the metal foil include an aluminum metal foil and the like.

Although the thickness of the base member can be appropriately selected from a range that does not spoil handleability, workability, and the like, it is suitable to select the thickness in a range from 20 μm to 200 μm inclusive in general. The base member may be formed from a single layer or multiple layers. Here, in order to improve the printing properties, a surface of the base member on a printing layer side may be subjected to a conventional surface treatment such as a corona discharge treatment, a plasma treatment, a flame treatment, and an acid treatment.

The adhesive layer for use in the sealing member can be appropriately selected while taking into account its adhesiveness to the housing 70 or to the base member. For example, it is possible to use any of acrylic-based adhesive agents, silicone-based adhesive agents, urethane-based adhesive agents, rubber-based adhesive agents, and the like. An acrylic-based adhesive agent is suitable in light of ease of controlling its adhesive physical properties by selecting a monomer type and controlling a molecular weight, a cross-link density and the like of a polymer, excellence in heat resistance and weather resistance, and a wide range of adhesive power that enables the design in a wide range from a weak adhesive type to a strong adhesive type, and so forth. Abase polymer of such an acrylic-based adhesive agent adopts an acrylic-based copolymer obtained by polymerizing an acrylic monomer while adding a cross-linking agent (such as isocyanate and epoxy) thereto. Any of alkyl acrylate or alkyl methacrylate (hereinafter collectively referred to as acryl (meth)acrylate) with a carbon number in a range from 1 to 20 is used as a monomer component. Such an alkyl base may have either a straight chain or a branched chain. To be more precise, examples of the monomer component include methyl (meth)acrylate, ethyl (meth)acrylate, n-propyl (meth)acrylate, isobutyl (meth)acrylate, and t-butyl (meth) acrylate. More examples thereof include pentyl (meth)acrylate, isopentyl (meth)acrylate, hexyl (meth)acrylate, heptyl (meth)acrylate, n-octyl (meth)acrylate, and isooctyl (meth) acrylate. More examples thereof include 2-ethylhexyl (meth)acrylate, nonyl (meth)acrylate, isononyl (meth)acrylate, decyl (meth)acrylate, isodecyl (meth)acrylate, undecyl (meth)acrylate, and dodecyl (meth)acrylate. More examples thereof include tridecyl (meth)acrylate, tetradecyl (meth) acrylate, pentadecyl (meth)acrylate, hexadecyl (meth)acrylate, heptadecyl (meth)acrylate, and octadecyl (meth)acrylate. More examples thereof include nonadecyl (meth) acrylate, icosyl (meth)acrylate, and the like. Among them, alkyl (meth)acrylate having the carbon number in the range from 2 to 10 is used more preferably. Methods of synthesizing acrylic polymers include solution polymerization, emulsion polymerization, UV polymerization, and the like. An appropriate method can be selected therefrom. One or more additives out of a tackifying agent, a softening agent, a bulking agent, an antioxidant agent, a heat stabilizing agent, a light stabilizing agent, an antistatic agent, a fire retardant agent, a blowing agent, a coloring agent, a dyeing agent, and the like may be added to the acrylic-based adhesive agent as appropriate.

A primer layer may be provided between the base member and the adhesive layer. If the primer is used on a surface of any of base members having low surface energy that may complicate adhesion of the adhesive agent, surface tension of such a base member is increased so that the adhesion between the base member and the adhesive agent can be strengthened as a consequence.

FIG. 11 is a table showing results of comparison of "ink supply performances" and "ink evaporation rates" in a case of attaching various sealing members 71 of different types to the ink cartridge 20. Here, a thickness of the base member of the sealing member 71, a coating thickness of the adhesive agent in the adherent region 71*a*, a coating thickness of the adhesive agent in the non-adherent region 71*b*, a width W of the non-adherent region 71*b*, and a layout of the adherent region 71*a* and the non-adherent region 71*b* are varied. Moreover, these cases are represented as validation examples 1 to 11. In the meantime, a case of not providing the sealing member 71 with the non-adherent region 71*b* and a case of not attaching the sealing member 71 to the ink cartridge 20 are also represented as comparative examples 1 and 2, respectively.

In the table, a remark SGS-110 in the row of the base member indicates the use of PP synthetic paper SGS-110 (manufactured by Yupo Corporation), and a remark SGS-80 in the row of the base member indicates the use of PP synthetic paper SGS-80 (manufactured by Yupo Corporation). A remark S-1511X in the row of the adhesive agent indicates the use of the acrylic-based adhesive agent S-1511X (manufactured by Toagosei Co., Ltd.) as the adhesive agent. Meanwhile, a remark S692N therein indicates the use of the acrylic-based adhesive agent S692N (manufactured by Avery Dennison Corporation) as the adhesive agent.

In the dimensions of the respective examples, the thickness is expressed in micrometers while the width is expressed in millimeters. Moreover, remarks a, b, and c in the row of the layout correspond to the layouts shown in FIGS. 10A, 10B, and 10C, respectively.

The ink cartridges 20 of the same type were used in these validation examples. The material of the housing 70 was PET while the material of the inner bag 77 was PE. The diameter of the substantially cylindrical housing 70 was set to 57 mm, the height thereof was set to 200 mm, and the thickness thereof was set to 0.5 mm. The thickness of the inner bag 77 was set to 0.1 mm. The ink in an amount of 400 g was injected into the inner bag 77. Then, the "ink supply performance" and the "ink evaporation rate" were evaluated for each example.

The "ink supply performance" was evaluated based on benchmarks of A to C by inserting the ink receiving pipe 21 into the coupling unit 25 of the ink cartridge 20 and sucking out the ink in the ink cartridge 20 at a pressure of −40 kPa. Details of the evaluation benchmarks A to C for the "ink supply performance" are shown below.

A: The ink in the ink cartridge was successfully depleted at a rate of 15 g or above per 20 s.

B: The ink in the ink cartridge was successfully depleted at a rate in a range of not less than 5 g but not more than 15 g per 20 s.

C: The ink in the ink cartridge was depleted at a rate below 5 g per 20 s or the ink was not successfully depleted.

The "ink evaporation rate" was evaluated based on benchmarks of A to C by measuring an amount of evaporation of the ink after leaving the ink cartridge 20 to stand in a constant-temperature bath at 60° C. for two weeks. Details of the evaluation benchmarks A to C for the "ink evaporation rate" are shown below.

A: The evaporation rate was below 1.1 times as large as an evaporation rate of an ink cartridge not provided with an air communication port.

B: The evaporation rate was equal to or more than 1.1 times but less than 1.5 times as large as the evaporation rate of the ink cartridge not provided with the air communication port.

C: The evaporation rate was equal to or more than 1.5 times as large as the evaporation rate of the ink cartridge not provided with the air communication port.

Each of the validation examples 1 to 11 gains evaluations of B or higher regarding the "ink supply performance" and the "ink evaporation rate". On the other hand, in the comparative example 1 where the non-adherent region 71*b* is not provided on the sealing member 71, the evaluation of the "ink supply performance" results in C because the air communication passage is not formed at the time of supplying the ink. On the other hand, in the comparative example 2 where the sealing member is not attached to the ink cartridge, the evaporation of the ink is accelerated because the air communication port 70*c* is constantly exposed to the air. Hence, the evaluation of the "ink evaporation rate" results in C.

In other words, each of the validation examples 1 to 11 adopting this embodiment can achieve an effect of suppressing evaporation of the ink and an effect of stably supplying the ink at the same time in contrast to the comparative examples with the "ink supply performance" or the "ink evaporation rate" evaluated as C.

Here, as a consequence of comparison among the validation examples 1 to 6, it turns out that the width W of the non-adherent region 71*b* is preferably equal to or above 1.0 mm and more preferably equal to or below 12.0 mm. Meanwhile, as a consequence of comparison among the validation examples 7 to 9, it is confirmed that the effects of this embodiment are achieved even if the type and the coating thickness of the adhesive agent in the adherent region 71*a* as well as the type and the thickness of the base member are varied to some extent. Moreover, as a consequence of comparison between the validation examples 10 and 11, it is confirmed that the effects of this example are achieved even if the layout of the adherent region 71*a* and the non-adherent region 71*b* is varied in accordance with FIGS. 10A to 10C.

Figure 12A:
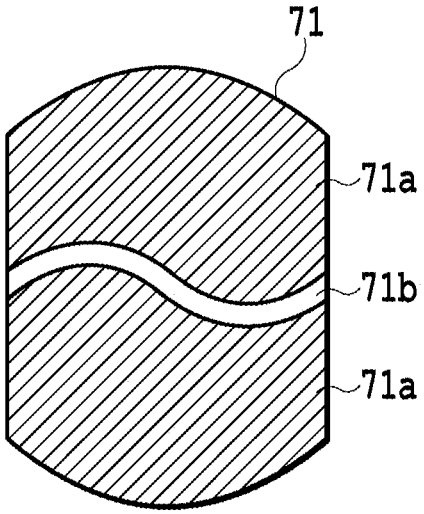
FIGS. 12A and 12B are diagrams showing layout examples of the adherent region and the non-adherent region.
Figure 12B:
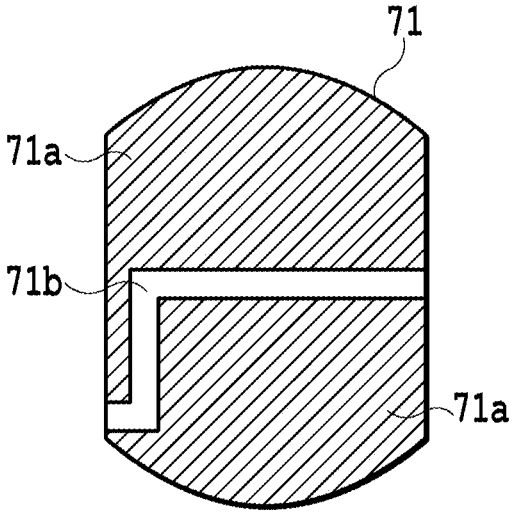

FIGS. 12A and 12B are diagrams showing more modified examples of the layout of the adherent region 71*a* and the non-adherent region 71*b* in the sealing member 71. The non-adherent region 71*b* may extend in a curved shape as shown in FIG. 12A or extend in a crank shape as shown in FIG. 12B. Meanwhile, the width W of the non-adherent region 71*b* may vary in the direction of extension.

Moreover, although it is not illustrated in the drawings, two or more non-adherent regions 71*b* may be provided on one sealing member. However, in consideration of the effect of suppressing the evaporation, positions where the non-adherent regions 71*b* can communicate with the air are preferably not more than two positions. According to an investigation conducted by the inventors involved in this disclosure, the width W of each non-adherent region 71*b* is preferably equal to or above 0.1 mm, or more preferably equal to or above 0.5 mm, or even more preferably equal to or above 1.0 mm from the viewpoint of securing the ink supply performance. The width W is preferably equal to or below 15.0 mm or more preferably equal to or below 12.0 mm from the viewpoint of suppressing the ink evaporation rate.

In any case, it is possible to achieve both the effect of suppressing the evaporation of the ink and the effect of stably supplying the ink at the same time by causing at least one end of the of the non-adherent region 71*b* to extend to an end portion of the sealing member 71 and locating the air communication port 70*c* at a position included in the non-adherent region 71*b*.

The coating thickness of the adhesive agent in the adherent region 71*a* is preferably equal to or above 1 μm and more preferably equal to or above 5 μm so as to sufficiently displace the non-adherent region 71*b* at the time of supplying the ink. Although the upper limit of the coating thickness is not limited to a particular thickness, the coating thickness is equal to or below 150 μM in general.

A method of manufacturing the sealing member 71 is not limited to a particular method. However, there is a method of subjecting only the portion corresponding to the adherent region 71*a* to an adhesive treatment by using screen printing, for example, in order to precisely lay out the adherent region 71*a* and the non-adherent region 71*b*. In the meantime, there are also other methods including a method of coating the adhesive agent on the entire surface of release paper and then partially scraping the adhesive agent off with a scraper or the like, a method of transferring a patterned adhesive layer formed on a roller, a method of partially removing the adhesive power by partially coating a varnish or the like on the adhesive layer, and so forth.

The shape of the sealing member 71 can be changed into various shapes in accordance with the shape of the housing 70. For example, the sealing member 71 may be of a circular shape, a rectangular shape, or a shape that combines the circular shape and the rectangular shape. Meanwhile, the size of the sealing member 71 is not limited. Nonetheless, in order to achieve the effect of suppressing the evaporation while covering the air communication port 70*c*, the size of a short side (a minor axis) of the sealing member 71 is preferably equal to or above 5 mm or more preferably equal to or above 10 mm.

Figure 13:
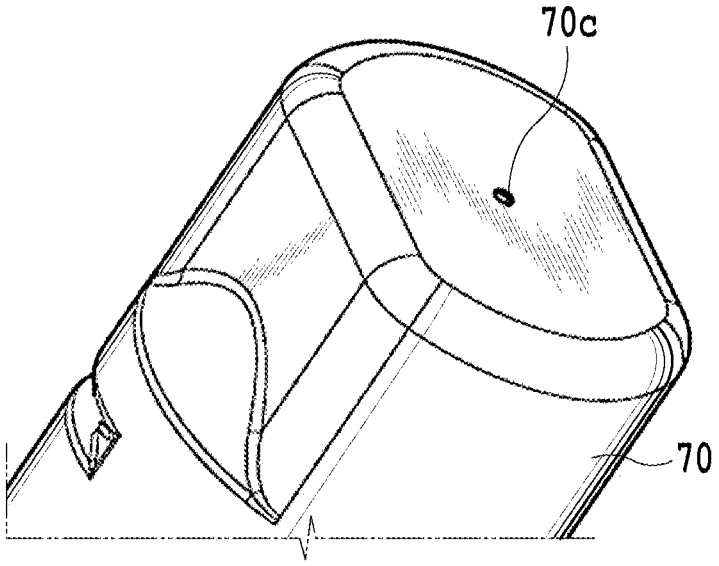
FIG. 13 is a perspective view showing a portion in the vicinity of the bottom surface of the ink cartridge.

Note that the bottom concave portion 70*b* of the housing 70 is not an essential configuration in this embodiment. As shown in FIG. 13, the bottom portion of the housing 70 may be formed into a flat surface and the air communication port 70*c* may be provided in the flat surface. What is more, the air communication port 70*c* does not always have to be provided at a bottom portion of the housing 70 and may be provided on a side surface of the housing 70, for example.

In any case, the communication passage for establishing the communication of the air at the time of supplying the ink can be formed by attaching the sealing member 71 such that the non-adherent region 71*b* extending to the end portion of the sealing member 71 covers the air communication port 70*c*. In other words, the aspect of attaching the sealing member 71 to the ink cartridge 20 can achieve the effect of suppressing the evaporation of the ink and the effect of stably supplying the ink at the same time.

Furthermore, the shape of the ink cartridge 20 is not limited to the shape shown in FIG. 3. For example, the joint unit 24 and the housing 70 may be formed from cylinders of the same thickness (the same diameter). Meanwhile, the housing 70 may be formed into the shape of a polygonal column such as a triangular prism and a quadrangular prism, or formed into the shape of a circular cone. Alternatively, the housing 70 may be formed into the shape of a polygonal pyramid such as a triangular pyramid and a quadrangular pyramid.

Second Embodiment

Figure 14:
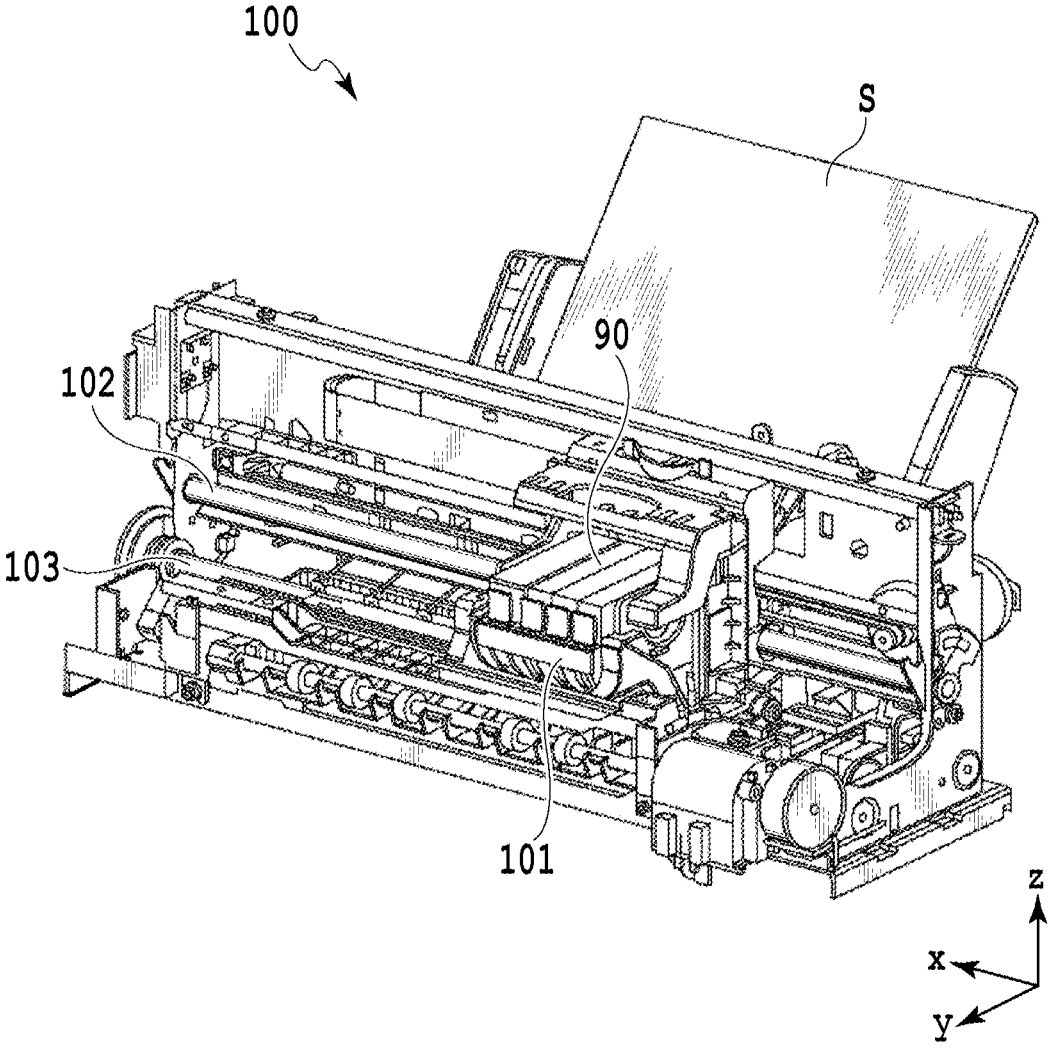
FIG. 14 is an internal configuration diagram of an inkjet printing apparatus used in a second embodiment.

FIG. 14 is an internal configuration diagram of an inkjet printing apparatus 100 used in a second embodiment. An x direction indicates a direction of movement (a horizontal direction) of a carriage 101, a y direction indicates a direction of conveyance of the print medium S, and a z direction indicates a vertical direction, respectively.

The inkjet printing apparatus 100 of this embodiment is a serial-type inkjet printing apparatus in which a not-illustrated recording head and ink cartridges 90 for supplying inks to this printing head are mounted on the carriage 101. In this embodiment, the four ink cartridges 90 storing cyan, yellow, magenta, and black inks, respectively, are detachably mounted on the carriage 101.

The carriage 101 is movable in the ±x directions by using a guide shaft 102. As the printing head ejects the inks in the −z direction in accordance with printing data in the process of movement of the carriage 101 in the ±x directions, an image for one band is printed on the print medium S. After the aforementioned print scanning for one session is performed, a conveyance roller 103 is rotated so as to convey the print medium S for a distance corresponding to one band in the y direction crossing the print scanning direction. The image is formed stepwise on the print medium S by alternately repeating the print scanning and the conveyance operation as described above.

Figure 15A:
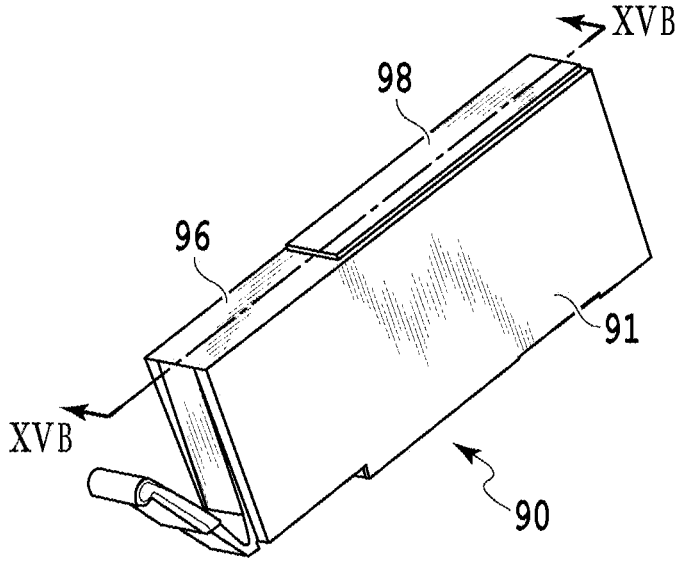
FIGS. 15A to 15C are diagrams showing an ink cartridge of the second embodiment.
Figure 15B:
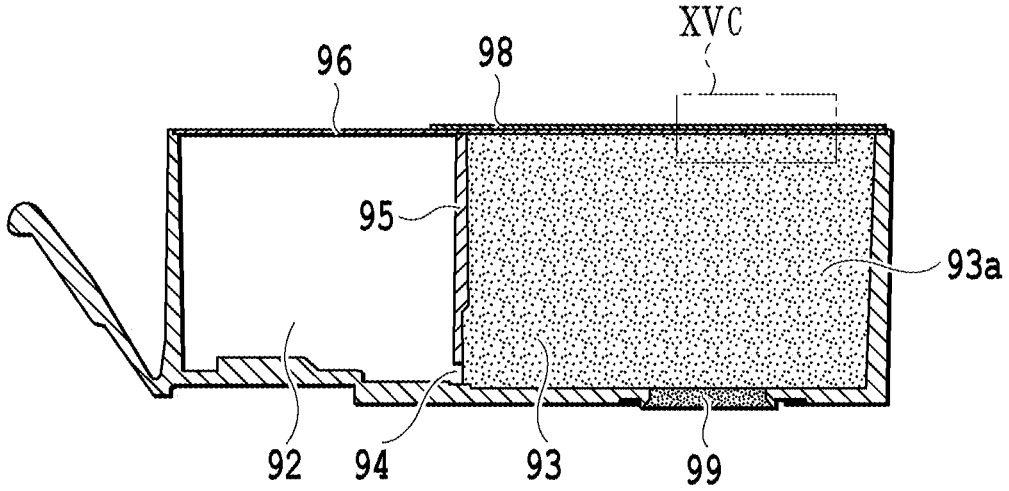
Figure 15C:
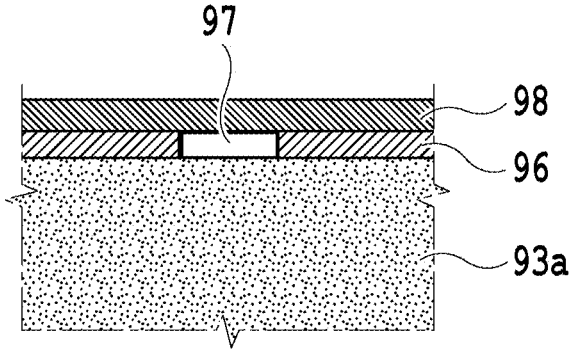

FIGS. 15A to 15C are diagrams showing the ink cartridge 90 of this embodiment. FIG. 15A is a perspective view of the ink cartridge 90, FIG. 15B is a cross-sectional view thereof, and FIG. 15C is an enlarged view in the vicinity of an air communication port 97. The ink cartridge 20 includes a housing 91 that takes on a substantially rectangular parallelepiped shape, and a cover member 96 is fitted to an upper surface of the housing 91. The cover member 96 is provided with a partition plate 95 that extends to a bottom surface of the housing 91, and partitions the inside of the housing 91 into a liquid storage chamber 92 and a negative pressure generation member storage chamber 93.

A liquid (the ink) is stored in the liquid storage chamber 92 while the negative pressure generation member storage chamber 93 is filled with a negative pressure generation member 93*a* such as sponge. A tip end of the partition plate 95 does not reach the bottom surface of the housing 91 and a communication unit 94 that establishes communication between the liquid storage chamber 92 and the negative pressure generation member storage chamber 93 is thus formed. A supply port 99 for supplying the ink to the externally connected printing head is formed at a bottom part of the negative pressure generation member storage chamber 93.

The air communication port 97 is formed at a position in the cover member 96 corresponding to the negative pressure generation member storage chamber 93. A sealing member 98 is attached to the housing 91 in such a way as to cover the air communication port 97.

Figure 16A:
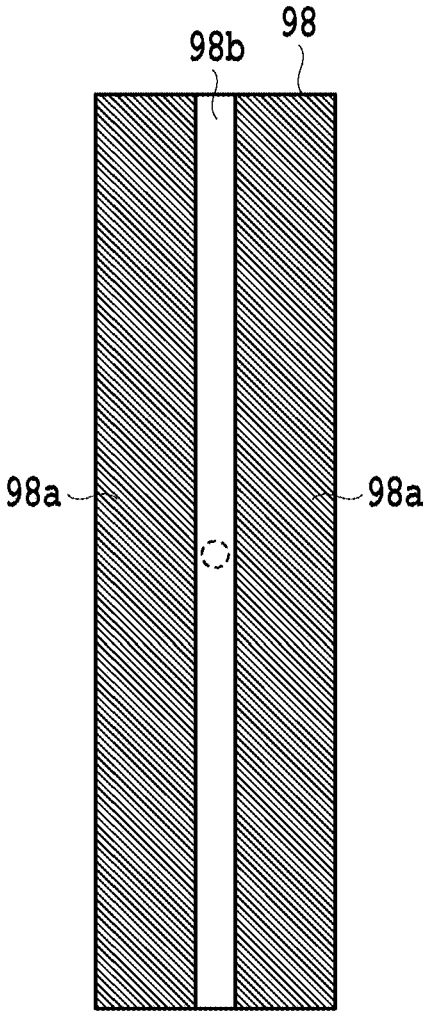
FIGS. 16A and 16B are diagrams showing layout examples of an adherent region and a non-adherent region.
Figure 16B:
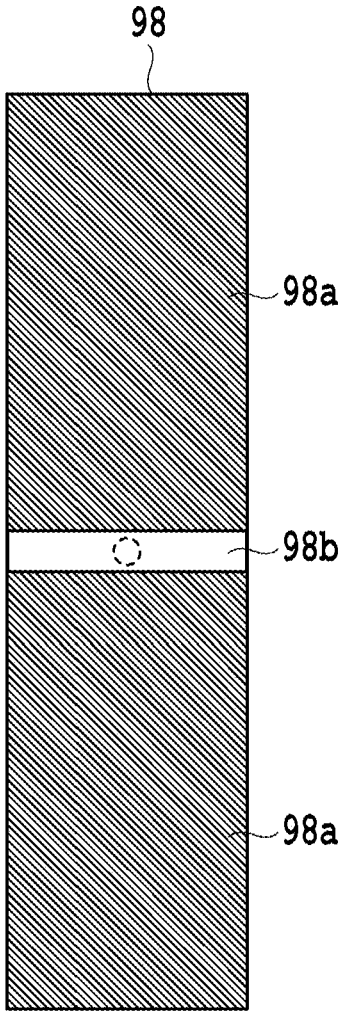

FIGS. 16A and 16B are diagrams showing layout examples of an adherent region 98*a* and a non-adherent region 98*b* in the sealing member 98 of this embodiment. FIG. 16A shows an example in which the non-adherent region 98*b* extends in a long side direction of the sealing member 98, and FIG. 16B shows an example in which the non-adherent region 98*b* extends in a short side direction of the sealing member 98. In any case, the air communication port 97 is located at a position corresponding to the non-adherent region 98*b* of the sealing member 98 in the state where the sealing member 98 is attached to the cover member 96.

At the time of manufacturing the ink cartridge 90, the ink is injected into the liquid storage chamber 92 before attaching the sealing member 98 to the cover member 96, that is, in a state where the air communication port 97 is open. The injected ink passes through the communication unit 94 and also enters the negative pressure generation member storage chamber 93, and is then absorbed and held by the negative pressure generation member 93*a*. Thereafter, the ink cartridge 90 is finished by attaching the sealing member 98 to the cover member 96, and is put into distribution in that state. A user attaches the ink cartridge 90 to the carriage 101 of the inkjet printing apparatus 100 without peeling the sealing member 98 off the ink cartridge 90 (see FIG. 14).

In the course of distribution or in the case where the ink cartridge 90 is attached to the carriage but no ink is supplied from the ink cartridge 90 to the printing head, the negative pressure generation member storage chamber 93 is kept at the atmospheric pressure whereby the sealing member 98 remains flat and smooth. As a consequence, the sealing member 98 blocks the air communication port 97 and suppresses the evaporation of the ink from the air communication port 97.

On the other hand, in the case where the ink is supplied from the supply port 99 to the printing head, the negative pressure generation member storage chamber 93 is temporarily decompressed. While a portion of the non-adherent region 98*b* in the vicinity of the air communication port 97 is attracted to the air communication port 97, the remaining region of the non-adherent region 98*b* is embossed by the reactive force as with the first embodiment. As a consequence, the communication passage that establishes the communication of the air is formed between the non-adherent region 98*b* and the cover member 96, and the air enters the negative pressure generation member storage chamber 93 which is in the decompressed state.

The air entering the negative pressure generation member storage chamber 93 is guided to the liquid storage chamber 92 through the communication unit 94 as well as a not-illustrated groove formed in the partition plate 95, and is stored in an upper part in the liquid storage chamber 92. Meanwhile, the ink stored in the liquid storage chamber 92 is supplied to the negative pressure generation member storage chamber 93 through the communication unit 94. As described above, the gas and the liquid are smoothly exchanged between the negative pressure generation member storage chamber and the liquid storage chamber. Accordingly, even in the case where the ink is consumed by an ejecting operation of the printing head, the ink in an amount equivalent to the consumed amount can be supplied stably from the ink cartridge 90 to the printing head.

In other words, this embodiment can achieve the effect of suppressing the evaporation of the ink and the effect of stably supplying the ink at the same time by covering a partial region of the cover member 96 inclusive of the air communication port 97 with the sealing member 98 provided with the non-adherent region 98*b*.

The above-described embodiment explains the characteristic configuration of this disclosure by using the example of the ink cartridge for use in the inkjet printing apparatus. However, this disclosure is not limited only to the aforementioned configuration. The liquid to be stored in the cartridge is not limited to the liquid used for the purpose of printing. For instance, in a case of manufacturing a biochip, a case of manufacturing an electronic circuit by using a printing technique, or in a case of manufacturing a semiconductor substrate, it is possible to use a liquid that serves as a material for forming wiring. In any case, the configuration of this disclosure can be effectively functioned in a case where a liquid used for a specific application is stored in a cartridge and the liquid is gradually consumed from the inside of the cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-184853 filed Sep. 28, 2018, which is hereby incorporated by reference wherein in its entirety.

What is claimed is:

1. An ink cartridge comprising:

a housing including an air communication port and configured to store a liquid inside; and a sealing member attached to the housing in such a way as to cover the air communication port, wherein the sealing member includes an adherent region attached to the housing at an attachment region and a non-adherent region not attached to the housing at a non-attachment region, wherein the non-adherent region extends to reach an end portion of the sealing member at the non-attachment region, and the sealing member is configured such that in a case where an inside of the housing is decompressed, a communication passage which establishes communication between the air communication port and air is formed through the non-adherent region at the non-attachment region, and in a case where an inside of the housing is an atmospheric pressure, communication between the air communication port and the air at the non-attachment region is prevented, whereby a communication state and a non-communication state between the air communication port and the air is changeable depending on variation of pressure in the housing.

2. The ink cartridge according to claim 1, wherein in a case where the supply unit ink cartridge supplies the liquid, the non-adherent region deforms at the non-attachment region to form the communication passage by being deformed along with decompression of an inside of the housing, and in a case where the ink cartridge does not supply the liquid, the non-adherent region does not deform.

3. The ink cartridge according to claim 1 wherein the air communication port is provided at a concave portion formed in the housing, and the sealing member is attached to the housing in such a way as to entirely cover the concave portion.

4. The ink cartridge according to claim 1 wherein the air communication port is provided on a flat and smooth surface of the housing, and the sealing member is attached to the housing such that the non-adherent region is opposed to the air communication port.

5. The ink cartridge according to claim 1 further comprising:

an inner bag located inside the housing and configured to store the liquid.

6. The ink cartridge according to claim 1 wherein the housing includes a liquid storage chamber configured to store the liquid, and a negative pressure generation member storage chamber configured to hold the liquid supplied from the liquid storage chamber by using a negative pressure generation member, and the air communication port is provided in the negative pressure generation member storage chamber.

7. The ink cartridge according to claim 1 wherein the non-adherent region has a width not smaller than 0.1 mm and not larger than 15.0 mm in a direction crossing a direction of its extension.

8. The ink cartridge according to claim 1 wherein the non-adherent region has a width not smaller than 1.0 mm and not larger than 12.0 mm in a direction crossing a direction of its extension.

9. The ink cartridge according to claim 1 wherein the non-adherent region extends from a central part to the end portion of the sealing member.

10. The ink cartridge according to claim 1 wherein the adherent region is a region provided with an adhesive agent, and the non-adherent region is a region not provided with the adhesive agent.

11. The ink cartridge according to claim 1 wherein the adherent region is a region provided with an adhesive agent, and the non-adherent region is a region in which a thickness of the adhesive agent is a relatively smaller than a thickness of the adhesive agent in the adherent region.

* * * * *